US007340208B2

(12) United States Patent
Ng

(10) Patent No.: US 7,340,208 B2
(45) **Date of Patent: *Mar. 4, 2008**

(54) METHOD AND APPARATUS FOR ELECTROSTATOGRAPHIC PRINTING WITH GENERIC COLOR PROFILES AND INVERSE MASKS BASED ON RECEIVER MEMBER CHARACTERISTICS

(75) Inventor: Yee S. Ng, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 87 days.

This patent is subject to a terminal disclaimer.

(21) Appl. No.: 11/155,268

(22) Filed: Jun. 17, 2005

(65) Prior Publication Data

US 2006/0285890 A1 Dec. 21, 2006

(51) Int. Cl.
*G03G 15/20* (2006.01)

(52) U.S. Cl. ..... 399/329; 399/341

(58) Field of Classification Search ..... 399/296, 399/320, 341, 342, 400, 401, 407
See application file for complete search history.

(56) References Cited

U.S. PATENT DOCUMENTS

| | | | | |
|---|---|---|---|---|
| 5,234,783 | A | 8/1993 | Ng | |
| 5,260,753 | A * | 11/1993 | Haneda et al. | 399/54 |
| 5,778,295 | A | 7/1998 | Chen et al. | |
| 6,535,712 | B2 * | 3/2003 | Richards | 399/341 |
| 6,567,641 | B1 | 5/2003 | Aslam et al. | |
| 6,608,641 | B1 | 8/2003 | Alexandrovich et al. | |
| 6,673,503 | B2 * | 1/2004 | Wagner et al. | 430/124 |
| 2003/0007814 | A1 * | 1/2003 | Richards | 399/341 |

* cited by examiner

*Primary Examiner*—David M. Gray
*Assistant Examiner*—Ryan Gleitz
(74) *Attorney, Agent, or Firm*—Donna P. Suchy

(57) ABSTRACT

A color electrostatographic printer apparatus applies respective color separation toner images to a receiver member to form a color image. A fuser assembly fuses the color image. A clear toner overcoat is then applied to the fused color toner image using a generic inverse mask that is based on receiver member characteristic. Enhanced glossing of the image is provided by a belt glosser that also improves color gamut. A generic color profile that is based on receiver member characteristics is provided to ensure color accuracy.

17 Claims, 15 Drawing Sheets

METHOD AND APPARATUS FOR ELECTROSTATOGRAPHIC PRINTING WITH GENERIC COLOR PROFILES AND INVERSE MASKS BASED ON RECEIVER MEMBER CHARACTERISTICS

FIELD OF THE INVENTION

The invention relates to color reproduction, and more particularly to color electrostatographic printers wherein color toner images are deposited upon a receiver member.

BACKGROUND OF THE INVENTION

In an electrophotographic modular printing machine of known type, for example, the NexPress 2100 printer manufactured by NexPress Solutions, Inc., of Rochester, N.Y., color toner images are made sequentially in a plurality of color imaging modules arranged in tandem, and the toner images are successively electrostatically transferred to a receiver member adhered to a transport web moving through the modules. Commercial machines of this type typically employ intermediate transfer members in the respective modules for the transfer to the receiver member of individual color separation toner images. Of course, in other electrostatographic printers, each color separation toner image is directly transferred to a receiver member.

Electrostatographic printers having a three, four, or more color (multicolor) capability are known to also provide an additional toner depositing assembly for depositing clear toner. The provision of a clear toner overcoat to a color print is desirable for providing protection of the print from fingerprints and reducing certain visual artifacts. However, a clear toner overcoat will add cost and may reduce color gamut of the print; thus, it is desirable to provide for operator/user selection to determine whether or not a clear toner overcoat will be applied to the entire print. In U.S. Pat. No. 5,234,783, issued on Aug. 10, 1993, in the name of Yee S. Ng, it is noted that in lieu of providing a uniform layer of clear toner, a layer that varies inversely according to heights of the toner stacks may be used instead as a compromise approach to establishing even toner stack heights. As is known, the respective color toners are deposited one upon the other at respective locations on the receiver member and the height of a respective color toner stack is the sum of the toner contributions of each respective color and provides the print with a more even or uniform gloss. In U.S. patent application Ser. No. 11/062,972, filed on Feb. 22, 2005, in the names of Yee S. Ng et al., a method is disclosed of forming a print having a multicolor image supported on a receiver member wherein a multicolor toner image is formed on the receiver member by toners of at least three different colors of toner pigments which form various combinations of color at different pixel locations on the receiver member to form the multicolor toner image thereon; forming a clear toner overcoat upon the multicolor toner image, the clear toner overcoat being deposited as an inverse mask; pre-fusing the multicolor toner image and clear toner overcoat to the receiver member to at least tack the toners forming the multicolor toner image and the clear toner overcoat; and subjecting the clear toner overcoat and the multicolor toner image to heat and pressure using a belt fuser to provide an improved color gamut and gloss to the image. The inverse masks, the pre-fusing conditions, and the belt fuser set points can be optimized based on receiver member types to maximize the color gamut. However, due to the significant change in the color gamut, new color profiles will need to be built for each receiver member used to obtain the desired color.

The present invention recognizes that rebuilding color profiles for each receiver member used based on the process described above is a costly approach. It would therefore be desirable to provide a method and apparatus that can make use of a few generic color profiles and provide a generic inverse mask based on receiver member characteristics that gives reasonable color accuracy for receiver members used with improved color gamut and gloss without having to rebuild color profiles for all receiver members.

SUMMARY OF THE INVENTION

The above and other aspects of the invention are realized in accordance with a first aspect of the invention wherein there is provided a method of forming a multicolor image on a receiver member by forming a multicolor toner image on the receiver member with toners of at least three different colors of toner pigments which form various combinations of color at different pixel locations on the receiver member to form the multicolor toner image thereon using a generic color profile based on receiver member characteristics; forming a clear toner overcoat upon the multicolor toner image; pre-fusing the multicolor toner image and clear toner overcoat to the receiver member to at least tack the toners forming the multicolor toner image and the clear toner overcoat; and fusing the clear toner overcoat and the multicolor toner image using a belt fuser to fix the clear toner overcoat to the receiver member and/or provide an improved gloss to the multicolor toner image.

In accordance with a second aspect of the invention wherein there is provided a method of forming a multicolor image on a receiver member by forming a multicolor toner image on the receiver member with toners of at least three different colors of toner pigments which form various combinations of color at different pixel locations on the receiver member to form the multicolor toner image thereon using a generic color profile based on receiver member characteristics; forming a clear toner overcoat upon the multicolor toner image, the clear toner overcoat being deposited as an inverse mask; pre-fusing the multicolor toner image and clear toner overcoat to the receiver member to at least tack the toners forming the multicolor toner image and the clear toner overcoat; and fusing the clear toner overcoat and the multicolor toner image using a belt fuser to fix the clear toner overcoat to the receiver member and/or provide an improved gloss to the multicolor toner image.

In accordance with a third aspect of the invention wherein there is provided a method of forming a multicolor image on a receiver member by forming a multicolor toner image on the receiver member with toners of at least three different colors of toner pigments which form various combinations of color at different pixel locations on the receiver member to form the multicolor toner image thereon using a generic color profile based on receiver member characteristics; forming a clear toner overcoat upon the multicolor toner image, the clear toner overcoat being deposited as a generic inverse mask based on receiver member characteristics; pre-fusing the multicolor toner image and clear toner overcoat to the receiver member to at least tack the toners forming the multicolor toner image and the clear toner overcoat; and fusing the clear toner overcoat and the multicolor toner image using a belt fuser to fix the clear toner overcoat to the receiver member and/or provide an improved gloss to the multicolor toner image.

In accordance with a fourth aspect of the invention wherein there is provided a method of forming a multicolor image on a receiver member by forming a multicolor toner image on the receiver member with toners of at least three different colors of toner pigments which form various combinations of color at different pixel locations on the receiver member to form the multicolor toner image thereon; forming a clear toner overcoat upon the multicolor toner image, the clear toner overcoat being deposited as a generic inverse mask based on receiver member characteristics; pre-fusing the multicolor toner image and clear toner overcoat to the receiver member to at least tack the toners forming the multicolor toner image and the clear toner overcoat; and fusing the clear toner overcoat and the multicolor toner image using a belt fuser to fix the clear toner overcoat to the receiver member and/or provide an improved gloss to the multicolor toner image.

Other objects, advantages, and novel features of the present invention will become more apparent from the following detailed description of the invention when considered in conjunction with the accompanying drawings.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings some elements have been removed and relative proportions depicted of the various disclosed elements may not be representative of the actual proportions, and some of the dimensions may be selectively exaggerated.

DETAILED DESCRIPTION OF THE INVENTION

Figure 1A:
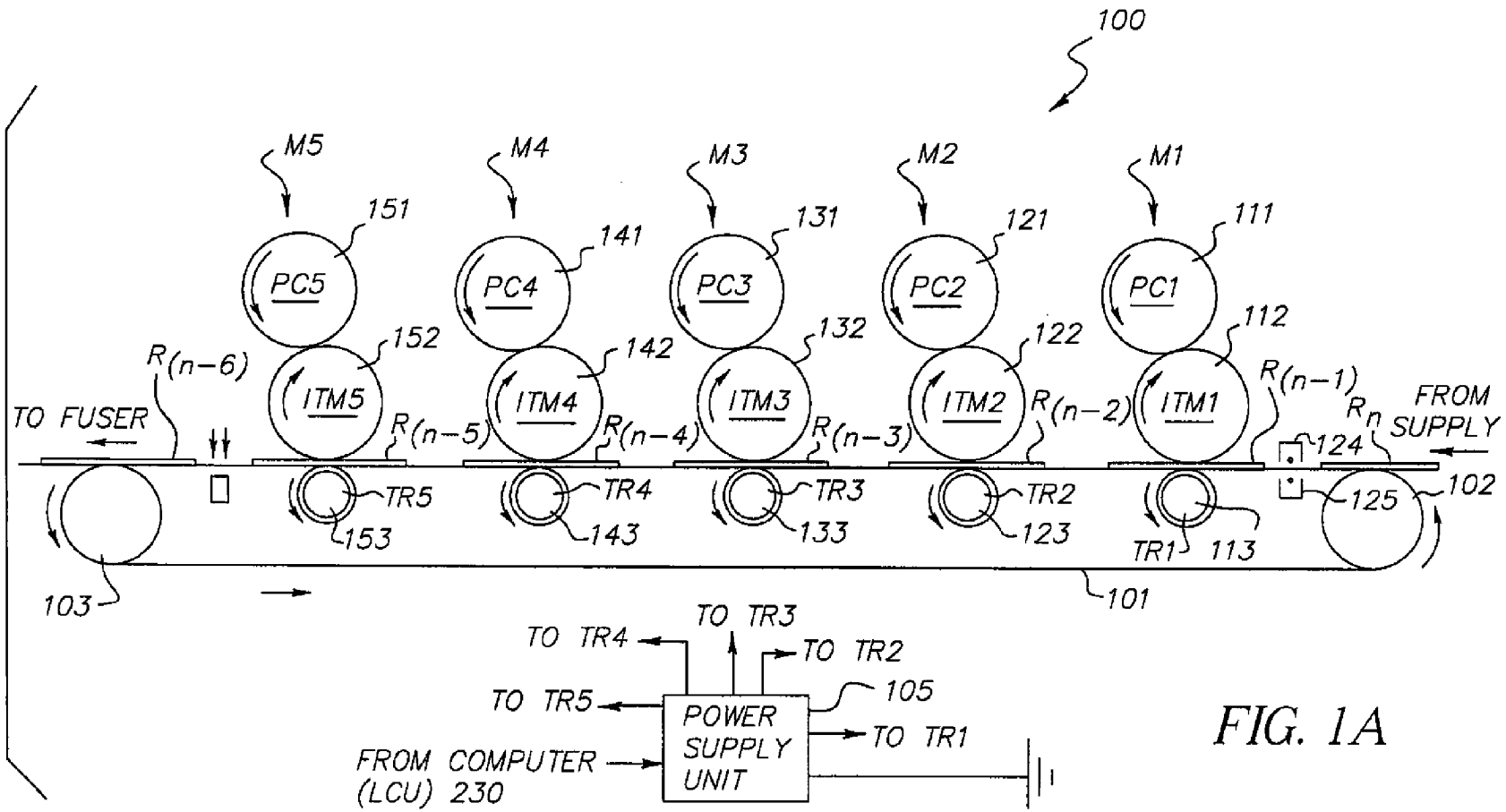
FIGS. 1A and 1B are schematic illustrations of a tandem electrophotographic print engine or printer apparatus, having five printing assemblies or modules that may be used in accordance with the present invention to generate multicolor prints.
Figure 1B:
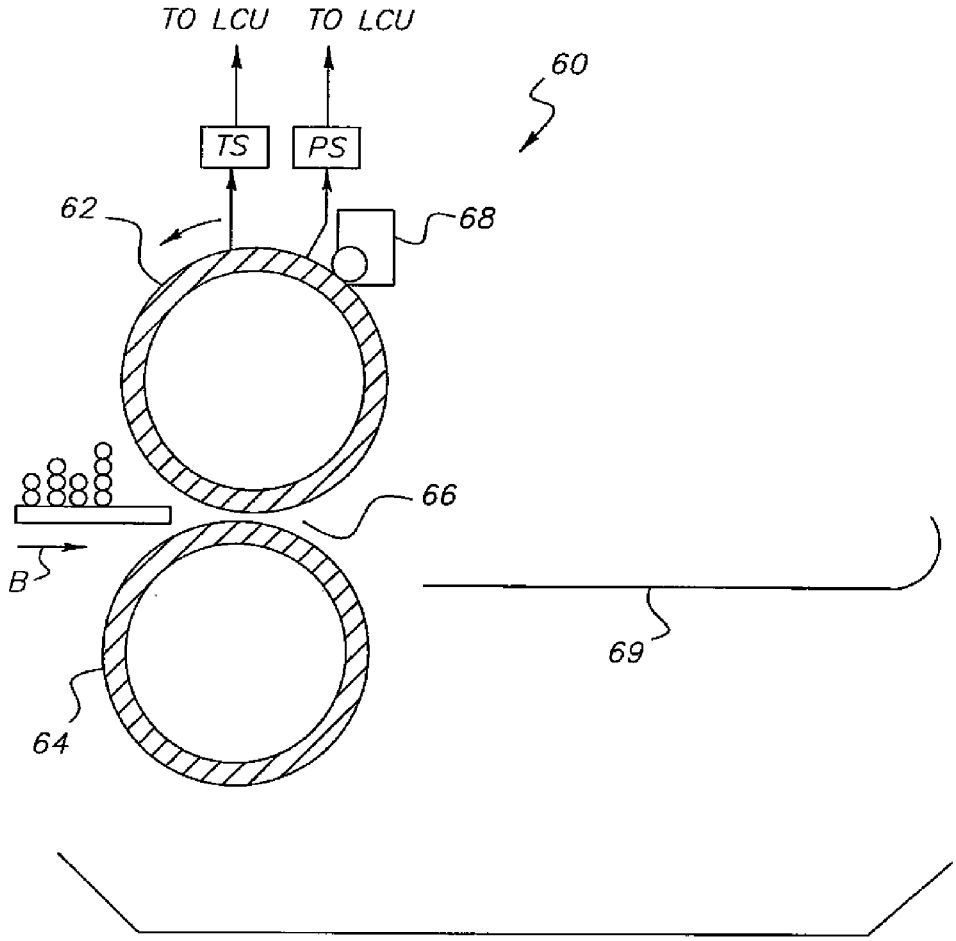

FIGS. 1A and 1B are side elevational views schematically showing portions of an electrophotographic print engine or printer apparatus suitable for printing multicolor toner images on receiver members. Although one embodiment of the present invention involves printing using an electrophotographic engine having five sets of singe-color image printing assemblies or modules that are arranged in a so-called tandem arrangement, the present invention contemplates that three, four, five, or more than five colors may be combined on a single receiver member. The present invention further contemplates that the images formed therein may also be generated using electrographic writers and thus the apparatus of the invention is broadly referred to as an electrostatographic reproduction or printer apparatus. In its broader aspects, the present invention contemplates that other processes may be used to create the multicolor images and then be coated with a clear toner overcoat in accordance with the teachings herein.

In FIG. 1A there is schematically illustrated an electrostatographic printer apparatus 100 having a number of tandemly arranged electrostatographic image forming modules or printing assemblies M1, M2, M3, M4, and M5. Each of the modules, M1 through M4, generate a single-color toner image for transfer to a receiver member successively moved through the modules. Module M5 is used to provide a clear toner overcoat as will be described in greater detail below. Each receiver member, during a single pass through the five modules, can have transferred in registration thereto, up to four single-color toner images to form a multicolor image with a clear toner overcoat. As used herein, the term multicolor implies that in an image formed on the receiver member, has combinations of subsets of plural primary colors combined to form other colors on the receiver member, at various locations on the receiver member; and the plural primary colors participate to form process colors in at least some of the subsets, wherein each of the primary colors may be combined with one more of the other primary colors at a particular location on the receiver member to form a color different than the specific color toners combined at that location. In a particular embodiment, M1 forms black (K) toner color separation images, M2 forms yellow (Y) toner color separation images, M3 forms magenta (M) toner color separation images, and M4 forms cyan (C) toner color separation images. Other printing assemblies or modules may be added before the clear toner printing assembly or module to form additional colors on the receiver member. Thus, additional modules may form one of red, blue, green, or other fifth or more color separation images. It is well known that the four primary colors: cyan, magenta, yellow, and black, may be combined in various combinations of subsets thereof to form a representative spectrum of colors and have a respective gamut or range dependent upon the materials used and process used for forming the colors. A fifth color may be added to improve the color gamut. In addition to adding to the color gamut, the fifth color may also be used as a specialty color toner image, such as for making proprietary logos.

Receiver members are delivered from a paper supply unit (not shown) and transported through the modules. The receiver members are adhered (e.g., preferably electrostatically via coupled corona tack-down chargers 124, 125) to an endless transport web 101 entrained and driven around rollers 102, 103. Alternatively, mechanical devices such as grippers, as is well known, may be used to adhere the receiver members to the transport web 101. The receiver members are preferably passed through a paper-conditioning unit (not shown) before entering the first module. Each of the modules (M1 through M5) includes a photoconductive imaging roller, an intermediate transfer member roller, and a transfer backup roller. Thus in module M1, a black color toner separation image can be created on the photoconductive imaging roller 111 (PC 1), transferred to intermediate transfer member 112 (ITM1), and transferred again to a receiver member moving through a transfer assembly, which transfer assembly includes the intermediate transfer member 112 (ITM1) forming a pressure nip with a transfer backup roller 113 (TR1). Similarly, modules M2, M3, M4, and M5 include, respectively: PC2, ITM2, TR2 (121, 122, 123); PC3, ITM3, TR3 (131, 132, 133); PC4, ITM4, TR4 (141, 142, 143); and PC5, ITM5, TR5 (151, 152, 153). A receiver member, $R_n$, arriving from the supply, is shown passing over roller 102 for subsequent entry into the transfer assembly of the first module, M1, in which the preceding receiver member $R_{(n-1)}$ is shown. Similarly, receiver members $R_{(n-2)}$, $R_{(n-3)}$, $R_{(n-4)}$, and $R_{(n-5)}$ are shown moving respectively through the transfer assemblies of modules M2, M3, M4, and M5. An unfused print formed on receiver member $R_{(n-6)}$ is moving as shown towards a fuser 60 shown in FIG. 1B for fusing the unfused print.

A power supply unit 105 provides individual transfer currents to the transfer backup rollers TR1, TR2, TR3, TR4, and TR5 respectively. A Logic and Control Unit (LCU) 230 (see FIG. 2) includes one or more computers and in response to signals from various sensors associated with the apparatus provides timing and control signals to the respective components to provide control of the various components and process control parameters of the apparatus in accordance with well understood and known employments. A cleaning assembly (not shown) for cleaning web 101 is also typically provided to allow reuse thereof.

Figure 2:
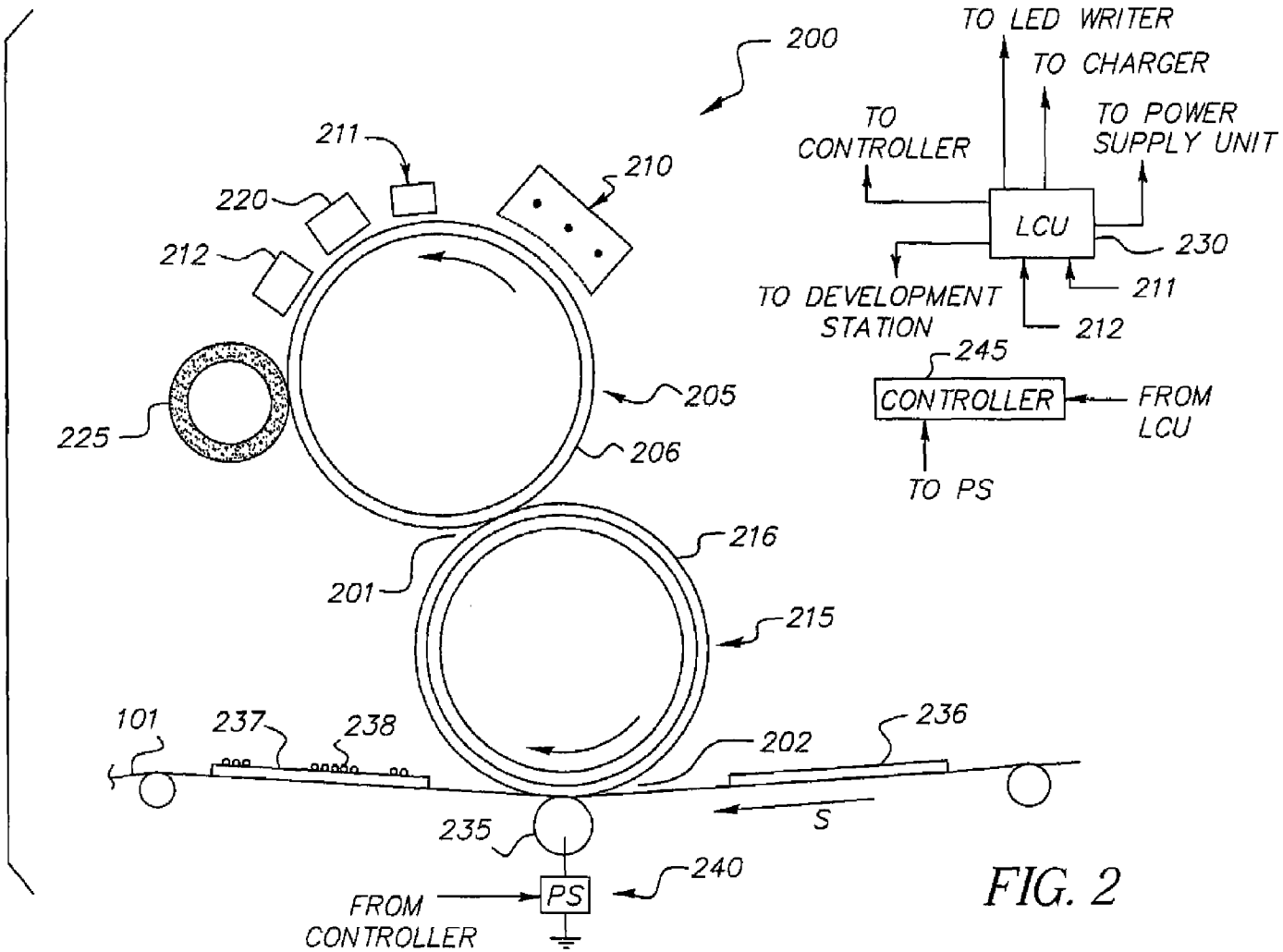
FIG. 2 is a schematic illustration of a representative printing assembly or module used in the print engine apparatus of FIG. 1A showing additional details thereof.

With reference to FIG. 2 wherein a representative color-printing module is shown, each color-printing module of the printer apparatus includes a plurality of electrophotographic imaging subsystems for producing a respective single-color toned image. Included in each module is a primary charging subsystem 210 for uniformly electrostatically charging a surface 206 of a photoconductive imaging member 205, shown in the form of an imaging cylinder, an exposure subsystem-220 for image-wise modulating the uniform electrostatic charge by exposing the photoconductive imaging member to form a latent electrostatic color separation image in the respective color, a development subsystem 225 for toning the image-wise exposed photoconductive imaging member with toner of the respective color, an intermediate transfer member 215 for transferring the respective color separation image from the photoconductive imaging member through a transfer nip 201 to the surface 216 of the intermediate transfer member 215, and through a second transfer nip 202 from the intermediate transfer member to a receiver-member (receiver member 236 shown prior to entry into the second transfer nip 202, and receiver member 237 shown subsequent to transfer of the toned color separation image) which receives the respective toned color separation images 238 in superposition to form a composite multicolor image thereon. Transfer to the receiver member is effected by an electrical field provided to a backup roller 235 from a power source 240. The fifth module or printing assembly, M5, is substantially identical to the other modules except that it contains a similar type of toner, which is lacking pigment (i.e., a clear toner).

Subsequent to transfer of the respective color separation images, one from each of the respective printing subsystems or modules, and transfer of the clear toner overcoat upon the multicolor image formed by the color separation images, the receiver member is advanced to a fusing subsystem 60 (FIG. 1B) to fuse or pre-fuse, that is at least tack the multicolor toner image and the clear toner overcoat "image" to the receiver member. Additional elements provided for control may be assembled about the various module elements, such as for example a meter 211 for measuring the uniform electrostatic charge and a meter 212 for measuring the post-exposure surface potential within a patch area of a latent image patch formed from time to time in a non-image area on surface 206. Further details regarding the printer apparatus 100 are also provided in U.S. Pat. No. 6,608,641, issued on Aug. 19, 2003, in the name of Peter S. Alexandrovich et al., the contents of which are incorporated herein by reference.

In an alternative embodiment, the photoconductive imaging member 205 can alternatively have the form of an endless web, and the intermediate transfer member 215 may also be an endless web, although it is preferred to be a compliant roller of a well-known type. The exposure device may include a Light Emitting Diode (LED) writer or laser writer or other electro-optical or optical recording element. Charging device 210 can be any suitable device for producing uniform pre-exposure potential on photoconductive imaging member 205, the charging device including, for example, any type of corona charger or roller charger. A cleaning device may be associated with the surface 206 of the photoconductive image recording member, and another cleaning device may be associated with the surface 216 of the intermediate transfer member after respective transfer of the toned images there from. Still other forms of electrostatographic recording apparatus may be used to form the multicolor image, and such apparatus need not have the color assemblies arranged in a tandem form as described herein.

Associated with each of the modules 200 is a main LCU 230, which receives input signals from the various sensors associated with the printer apparatus and sends control signals to the chargers 210, the exposure subsystem 220 (e.g., LED writers) and the development subsystem 225 of the modules. Each module may also have its own respective controller coupled to the printer apparatus main LCU 230.

Subsequent to the transfer of the three, four, or more color toner separation images and the clear toner overcoat image in superposed relationship to each receiver member, the receiver member is then detacked from transport web 101 and sent in a direction indicated by arrow B (in FIG. 1B) to a fusing assembly 60 to fuse, or fix, the dry toner images to the receiver member. The transport web 101 is then reconditioned for reuse by cleaning and providing charge to both surfaces, which neutralizes charge on the two surfaces of the transport web.

The electrostatic image is developed, preferably using the well known discharged area development technique, by application of pigmented marking particles to the latent image bearing photoconductive drum by the respective exposure subsystem 220, which development subsystem 225 preferably employs so-called SPD (Small Particle Dry) developers. Each of the development assemblies, is respectively electrically biased by a suitable respective voltage, to develop the respective latent image, which voltage may be supplied by a power supply or by individual power supplies (not illustrated). Preferably, the respective developer is a two-component developer that includes toner marking particles and magnetic carrier particles. Each color development assembly has a particular color of pigmented toner marking particles associated respectively therewith for toning. Thus, each of the four modules, M1 through M4, creates a different color marking particle image on the respective photographic drum. Alternatively, the developer may be a singe-component developer. It is also contemplated that the color toners may each be associated with a liquid developer. As will be discussed further below, a clear toner development assembly may be substituted for one of the pigmented developer assemblies so that the module M5 operates in similar manner to that of the other modules which deposits pigmented toner; however, the development assembly of the clear toner module has toner particles associated respectively therewith that are similar to the toner marking particles of the color development assemblies but without the pigmented material incorporated within the toner.

With reference to FIG. 1B transport belt 101 serially transports the toner image carrying receiver members to a fusing or fixing assembly 60, which fixes or at least tacks the toner particles to the receiver member by the application of heat and pressure. More particularly, fusing assembly 60 includes a heated fusing roller 62 and an opposing pressure roller 64 that forms a fusing nip 66 there between. Fusing assembly 60 also includes a release fluid application subassembly generally designated 68 that applies release fluid, such as, for example, silicone oil, to fusing roller 62. The release fluid substantially prevents toner particles from sticking to the fuser roller 62.

The receiver member carrying the fused image (or at least tacked image) is transported from the fusing assembly 60 along a path to either a remote output tray 69 (when no clear toner overcoat is to be employed) or to a glossing assembly 70 (see FIG. 3) if a clear toner overcoat is to be provided. In the embodiment shown, glossing assembly 70 is a standalone and/or off-line unit. However, it is to be understood that glossing assembly 70 can alternatively be configured as an integral and/or built-in assembly of the printer apparatus 100.

Figure 3:
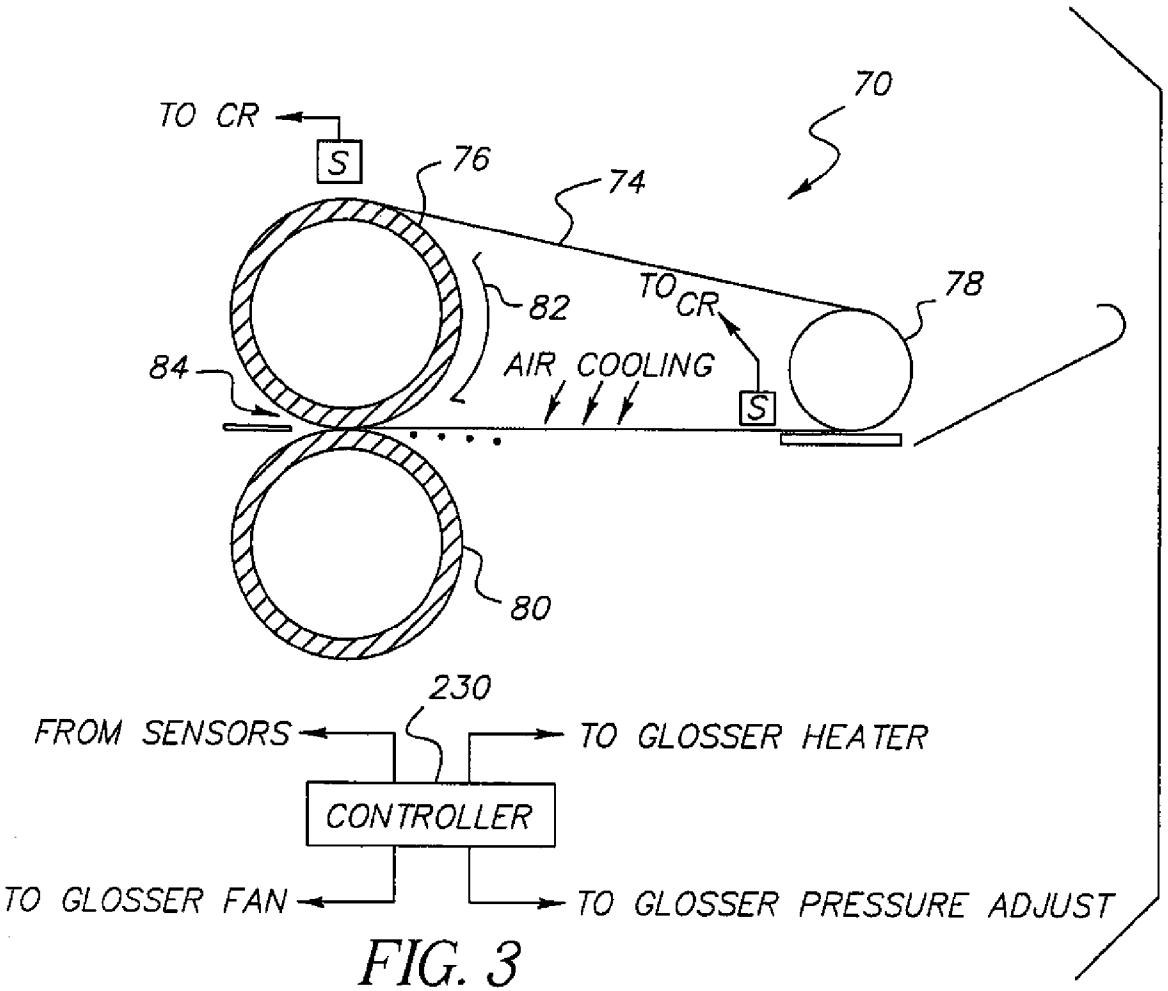
FIG. 3 is a schematic illustration of a belt glosser apparatus that may be used in accordance with the present invention.

With reference to FIG. 3, glossing assembly 70 includes a finishing or fusing belt 74 also referred to as a belt fuser, heated glossing roller 76. steering roller 78, pressure roller 80, and heat shield 82. Fusing belt 74 is entrained about glossing roller 76 and steering roller 78. The fusing belt 74 includes a release surface of an organic/inorganic glass or polymer of low surface energy, which minimizes adherence of toner to the fusing belt 74. The release surface may be formed of a silsesquioxane, through a sol-gel process, as described for the toner fusing belt disclosed in U.S. Pat. No. 5,778,295, issued on Jul. 7, 1998, in the names of Jiann-Hsing Chen et al. Alternatively, the fusing belt release layer may be a poly (dimethylsiloxane) or a PDMS polymer of low surface energy, see in this regard the disclosure of U.S. Pat. No. 6,567,641, issued on May 20, 2003, in the names of Muhammed Aslam et al. Pressure roller 80 is opposed to, engages, and forms glossing nip 84 with heated glossing roller 76. Fusing belt 74 and the image bearing receiving member are cooled, such as, for example, by a flow of cooling air, upon exiting the glossing nip 84 in order to reduce offset of the image to the finishing belt 74.

The previously disclosed LCU 230 includes a microprocessor and suitable tables and control software which is executable by the LCU 230. The control software is preferably stored in memory associated with the LCU 230. Sensors associated with the fusing and glossing assemblies provide appropriate signals to the LCU 230 when the glosser is integrated with the printing apparatus. In any event, the glosser can have separate controls providing control over temperature of the glossing roller and the downstream cooling of the fusing belt and control of glossing nip pressure. In response to the sensors, the LCU 230 issues command and control signals that adjust the heat and/or pressure within fusing nip 66 so as to reduce image artifacts which are attributable to and/or are the result of release fluid disposed upon and/or impregnating a receiver member that is subsequently processed by/through glossing assembly 70, and otherwise generally nominalizes and/or optimizes the operating parameters of fusing assembly 60 for receiver members that are not subsequently processed by/through glossing assembly 70.

Figure 6A:
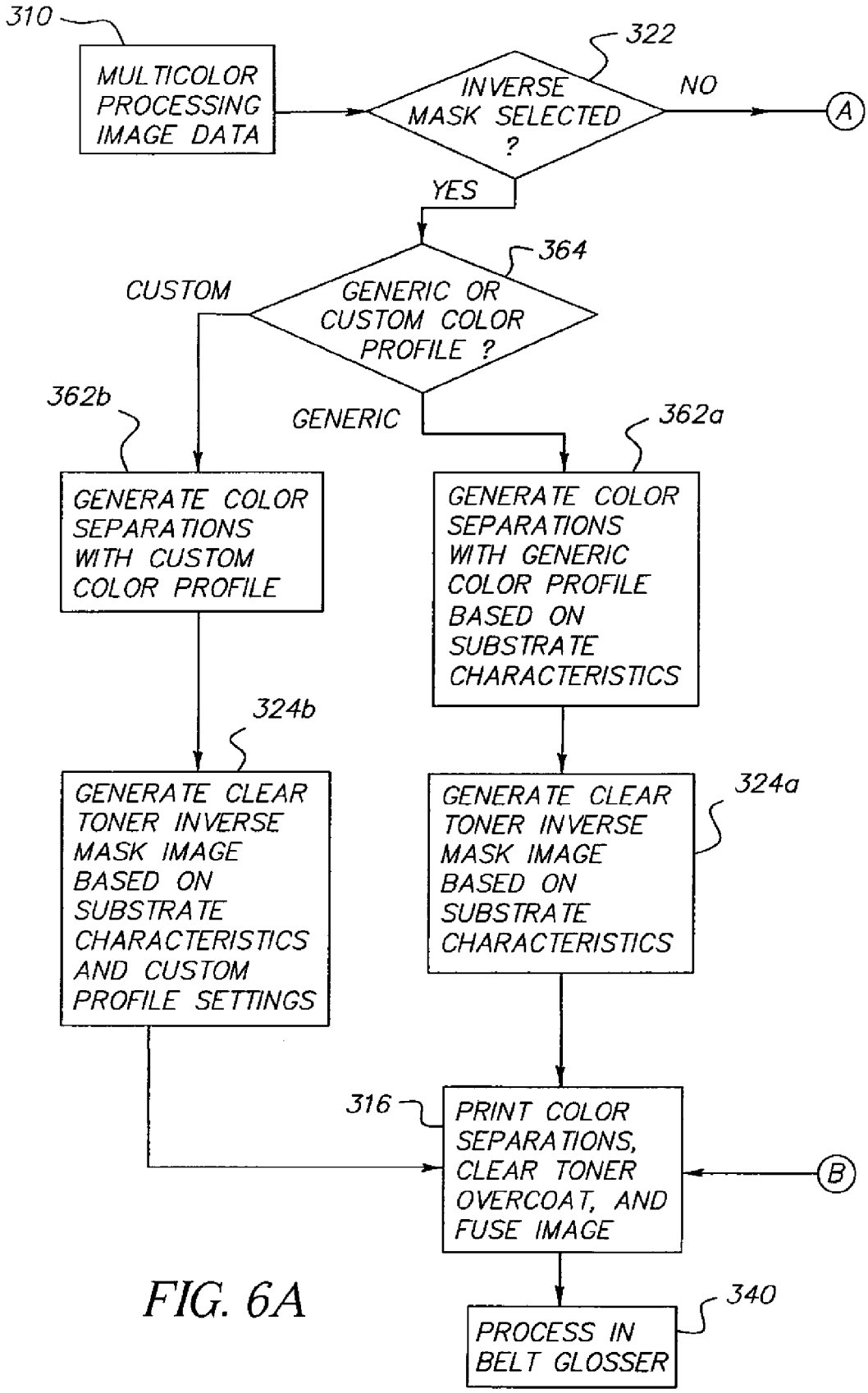
FIG. 6 is a flowchart illustrating operation of the apparatus of FIGS. 1 through 3 in accordance with the method of the present invention.
Figure 6B:
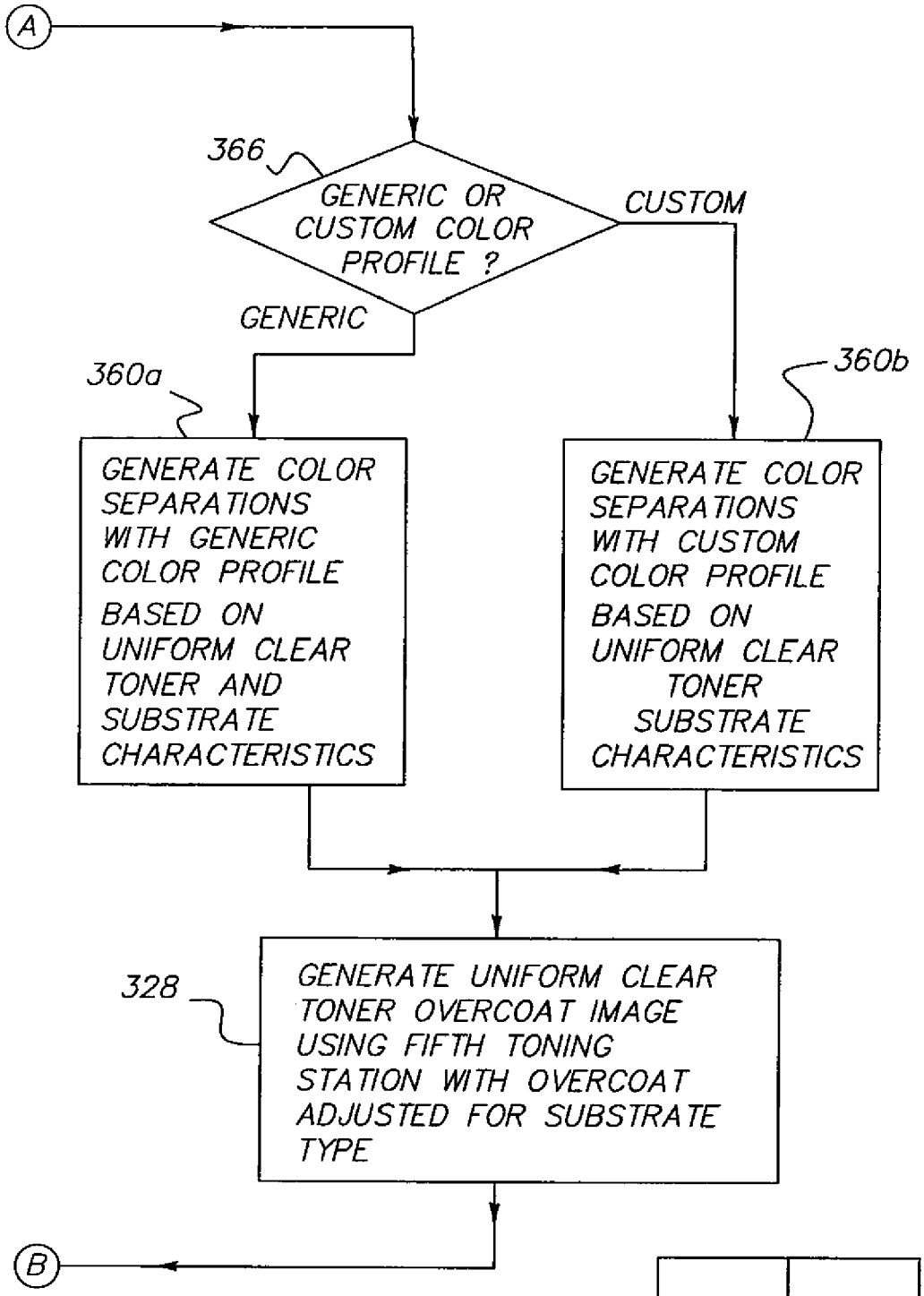
Figure 6:
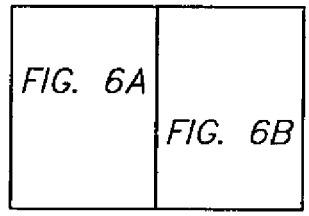

With reference now to the flowchart 300 of FIG. 6, the assumption is that multicolor image data is provided in step 310. Subsequent processing of the multicolor image data depends upon whether or not the operator has input, via an input device such as a computer terminal or other operator input device, a request for an inverse mask for the clear toner or a uniform clear toner overcoat, a generic or a custom color profile, and whether subsequent glossing treatment is needed. Through a single pass of the receiver member through the four-color printing assemblies and the clear toner printing assembly M1 through M5 of printing apparatus 100, a receiver member in the form, of a sheet, which may be of a paper, plastic, coated metal, or a textile material, receives four color toner separation images formed thereon. Typically, the parameters for nominal fusing of a typical receiver member, such as paper, will be dependent upon the thickness and/or weight of the paper and its surface characteristics, such as manufactured gloss finish or matte finish. Subsequent to fusing, the image formed on the surface is complete, step 316, and no further processing of this receiver member is required, except for perhaps forming another image on the opposite surface, i.e. duplex image formation which is a standard practice and need not be discussed further herein. The receiver member is then passed to the belt glosser for finishing if so instructed for subsequent glossing treatment in step 340. The development assemblies may contain a coding that is automatically sensed by the printer apparatus so that processing conditions for using the toners are automatically established.

If a gloss enhancement of a print is selected, a determination is made in step 322 as to whether or not an inverse mask is selected. In lieu of providing a uniform application of clear toner to cover the entire image area, it is known to reduce the amount of clear toner by application of an inverse mask wherein more clear toner is laid in areas that have less color toner coverage. In this inverse mask mode, balance is created in toner stack heights by providing relatively greater amounts of clear toner coverage to areas of an image having relatively lower amounts of color toner coverage, and lesser amounts of clear toner coverage to areas of the image having relatively greater amounts of color toner coverage. In this regard, reference is made to U.S. Pat. No. 5,234,783, issued on Aug. 10, 1993, in the name of Yee S. Ng. However, as may be seen with reference to the graph shown in FIG. 4, an improvement in color gamut can be obtained with the use of the inverse mask and belt gloss enhancement.

Figure 4:
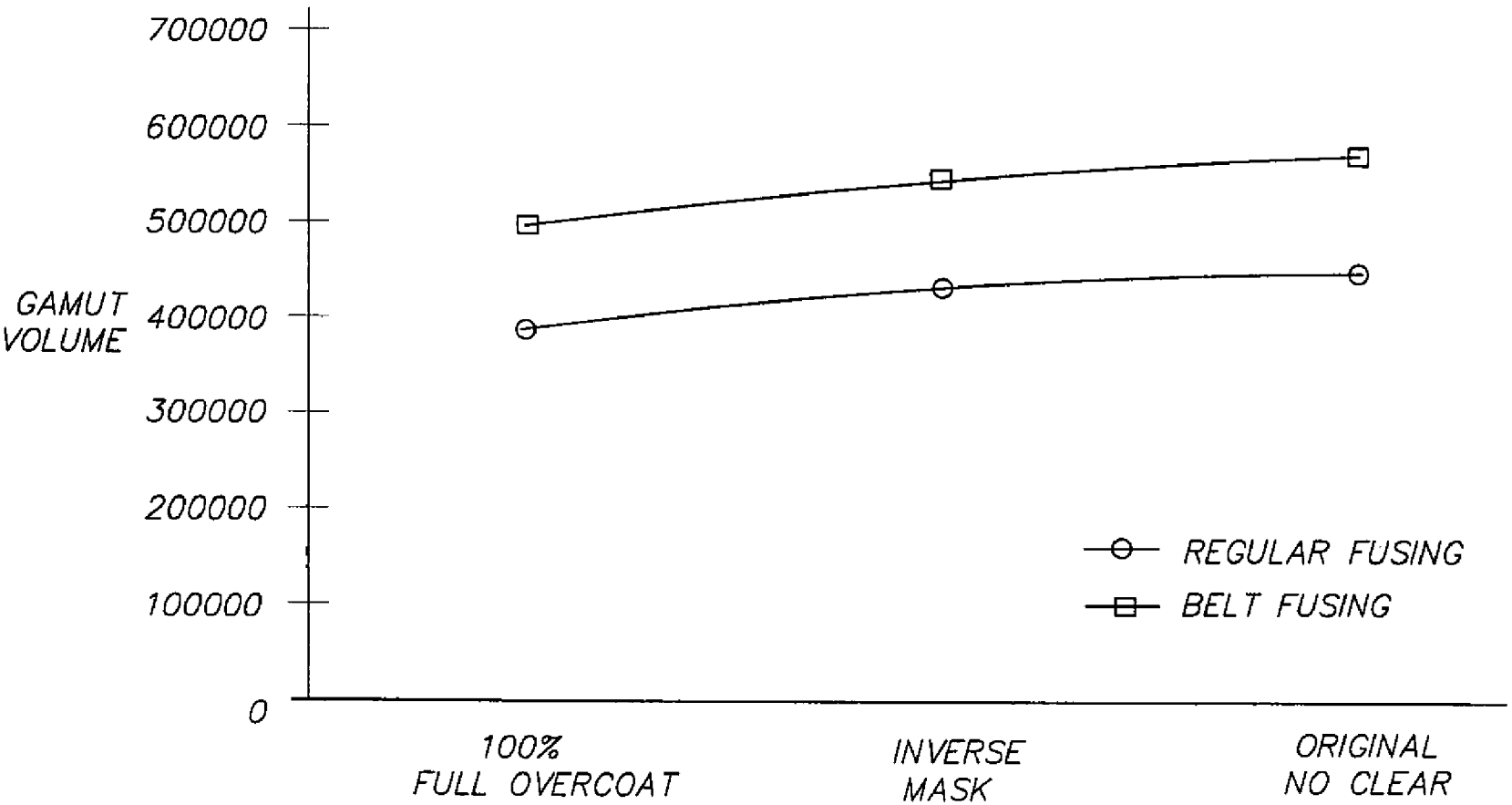
FIG. 4 is a graph showing gamut volume for formation of a multicolor electrophotographic image in accordance with different treatments involving use of a clear toner overcoat including no overcoat.

In FIG. 4 various strategies of application of clear toner, or clear toner, are illustrated along with the respective color gamut volume achieved. In the example of the use of 100% full overcoat, it can be seen that a multicolor image subject to regular fusing but no gloss enhancement had a significantly lower color gamut volume than a similarly produced multicolor image having a 100% full overcoat of clear toner applied but subjected to reduced fusing and then subjected to gloss enhancement by a belt fuser 74. However, it will be noted that a multicolored image having no clear toner overcoat but subjected to regular fusing had a significantly lower color gamut volume than a similar multicolored image having no clear toner overcoat but subjected to a reduced fusing condition and then belt fusing. In the case of a multicolored image that is covered with clear toner using an inverse mask but subjected to a reduced fusing condition and then belt fusing for gloss enhancement, it was unexpectedly noted that significant improvement in color gamut is obtained relative to the case of the multicolored image also having clear toner using an inverse mask but being subjected to regular fusing and no belt fusing. What is particularly interesting is that the provision of the print with clear toner using an inverse mask and belt fusing and/or glossing can provide not only the protection afforded by the presence of the clear overcoat in the abrasion vulnerable regions of the multicolored image but that a meaningful improvement in color gamut obtains over that of the case where a similar color toner image is formed on a similar receiver member but using a 100% full uniform overcoat of clear toner that is provided as shown in U.S. patent application Ser. No. 11/062,972, filed on Feb. 22, 2005, in the names of Yee S. Ng et al. In some cases the use of the inverse mask for the clear toner with belt fusing and/or glossing upon a multicolor toner image there may also be an improved color gamut provided over that of the case of a similar multicolor image formed upon a similar receiver member but receiving no clear toner overcoat and no belt glossing.

Figure 5:
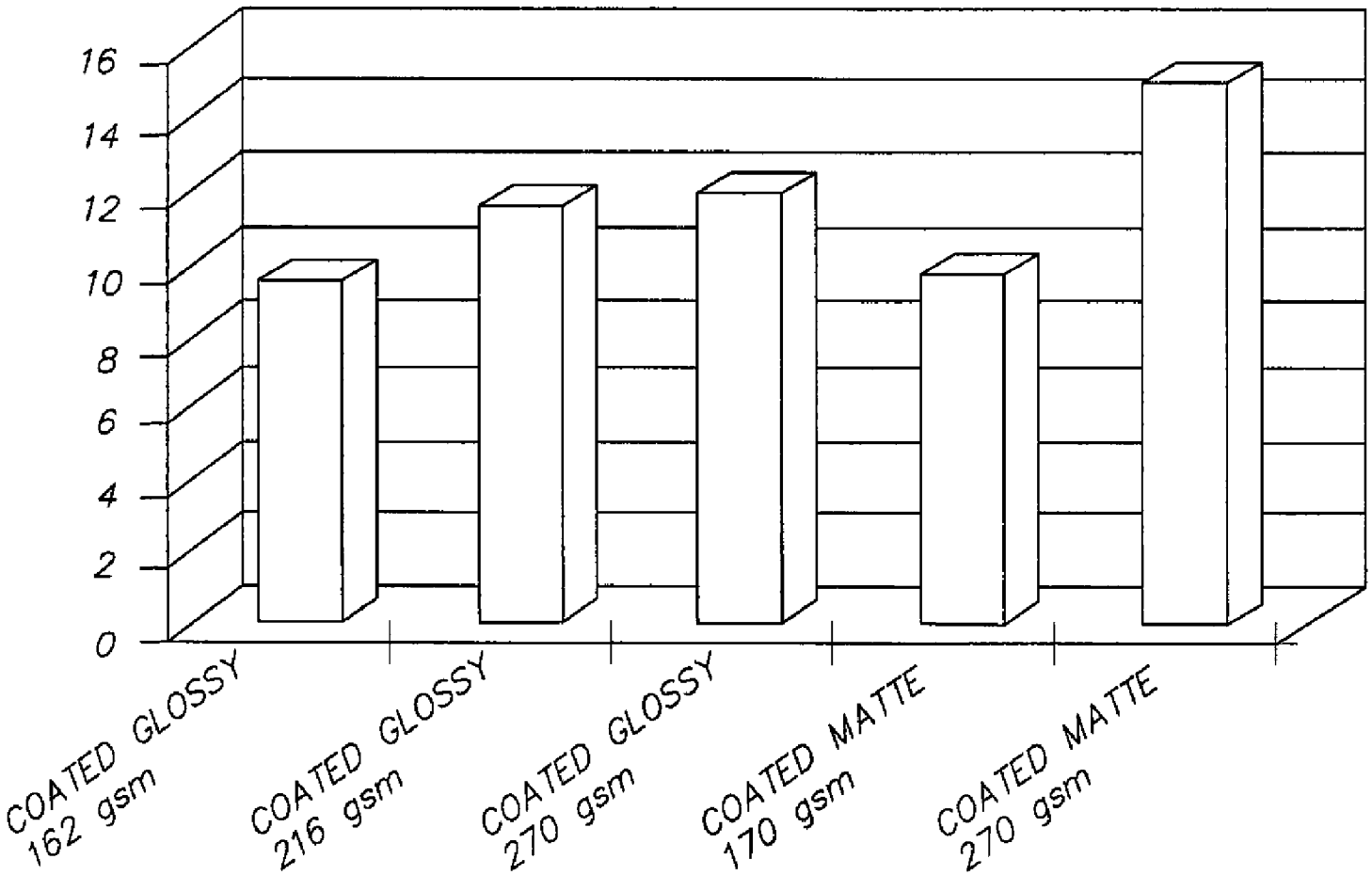
FIG. 5 is a bar chart that illustrates the increase in color gamut on various receiver members using the process of a clear tone inverse mask and belt glosser.

FIG. 5 shows the percent increase in color gamut for a large variety of receiver members (coated glossy and coated matte of wide weight range) using the clear toner inverse mask with the belt glosser when the fusing and glossing conditions of the print engine and belt glosser are optimized for the receiver member.

The LCU 230 of the printer apparatus 100 may be programmed so as to be operative, for example by selection by the operator, to process the printing of a clear toner image in accordance with plural selectable modes so that some prints may be formed that are uniformly covered with clear toner and other prints may be formed with the clear toner deposited or printed in an inverse mask mode, wherein balance is achieved in toner stack heights. Further details regarding the inverse mask mode are provided below.

Where an overall uniform clear toner overcoat is selected, step 322 (FIG. 6), i.e., not inverse mask mode, the electro-optical recording element associated with the fifth image forming module M5 may be enabled in accordance with the information for establishing or printing an overall uniform coat in clear toner. Depending on whether a custom or generic color profile is selected, as in step 366, color image data can be generated in step 360*a* (if the generic color profile is selected) or in step 360*b* (if the custom color profile is selected), in accordance with paper type, a uniform clear toner overcoat used, and pixel-by-pixel locations printed, developed, and fused as in step 316. Clear toner image data may be generated as in step 328 and developed and fused as in step 316 in accordance with paper type, and the pixel-by-pixel locations suitably discharged, or the electrostatic charge on the photoconductive surface of the imaging cylinder suitably reduced, in the entire area where discharge area development is employed. More preferably, the electro-optical writer may be disabled and the uniform charger and clear toner development assembly electrical bias adjusted to provide a charge suitable for developing on the imaging cylinder an overall clear toner in the image area by the clear toner development assembly of a thickness suited for the receiver member type, step 316.

Where the inverse mask mode is selected, the electro-optical recording element associated with the fifth image-forming module M5 is enabled in accordance with the information for establishing or printing an inverse mask in clear toner. Depending on whether a custom or generic color profile is selected, as in step 364, color image data can be generated in step 362*a* (if the generic color profile is selected) or in step 362*b* (if custom color profile is selected), in accordance with paper type, the type of clear toner inverse mask masks clear toner overcoat that is going to be used, and pixel-by-pixel locations printed, developed and fused as in step 316. Image data for the clear toner inverse mask is generated in accordance with paper type and the pixel-by-pixel locations as to where to apply the clear toner, step 324*a* (when the generic color profile is selected) or step 324*b* (when the custom color profile is selected). Information regarding the multicolor image is analyzed by a Raster Image Processor (RIP) 501 (see FIG. 7) associated with the LCU 230 to establish on a pixel-by-pixel basis as to where pigmented toner is located on the multicolor printed receiver member. Pixel locations having relatively large amounts of pigmented toner are designated as pixel locations to receive a corresponding lesser amount of clear toner so as to balance the overall height of pixel locations with combinations of pigmented toner and clear toner. Thus, pixel locations having relatively low amounts of pigmented toner are provided with correspondingly greater amounts of clear toner, step 316. With reference to FIG. 8, there are exemplary graphs illustrating various inverse masks providing a relationship relative to amounts of clear toner to be deposited at pixel locations versus amounts of pigmented toner in the multicolor image at the corresponding pixel location using one of the inverse masks illustrated. In the printing of the clear toner as an inverse mask, the inverse mask image data may be processed either as a halftone or continuous tone image. In the case of processing this image as a halftone, a suitable screen angle may be provided for this image to reduce moire patterns.

In step 340 (FIG. 6), the receiver member with the clear toner overcoat, whether it be through an inverse mask printing or uniform overcoating, is processed in the belt glosser to complete the fusing of the clear toner overcoat in the multicolor image to the receiver member.

The inverse mask preferably is adjusted for the type of receiver member as will be described below. Additionally, the amount of uniform clear toner overcoat provided where that mode is selected may also be adjusted for the type of receiver member. The fusing conditions and the conditions of the belt glosser are also adjusted for the type of receiver member.

As noted in commonly assigned U.S. patent application Ser. No. 10/933,986, filed on Sep. 3, 2004, in the name of Yee S. Ng, a third mode may also be provided wherein back-transfer artifacts are reduced or eliminated without the need or expense of providing uniform coverage of clear toner to the print using a five-color tandem printer to print fewer than five colors. In this third mode, the fifth assembly may be used during the one pass through the printer apparatus as a clear toner assembly to deposit more clear toner in relatively higher colored areas and less clear toner in areas having relatively lower amounts of colored toner.

Figure 7:
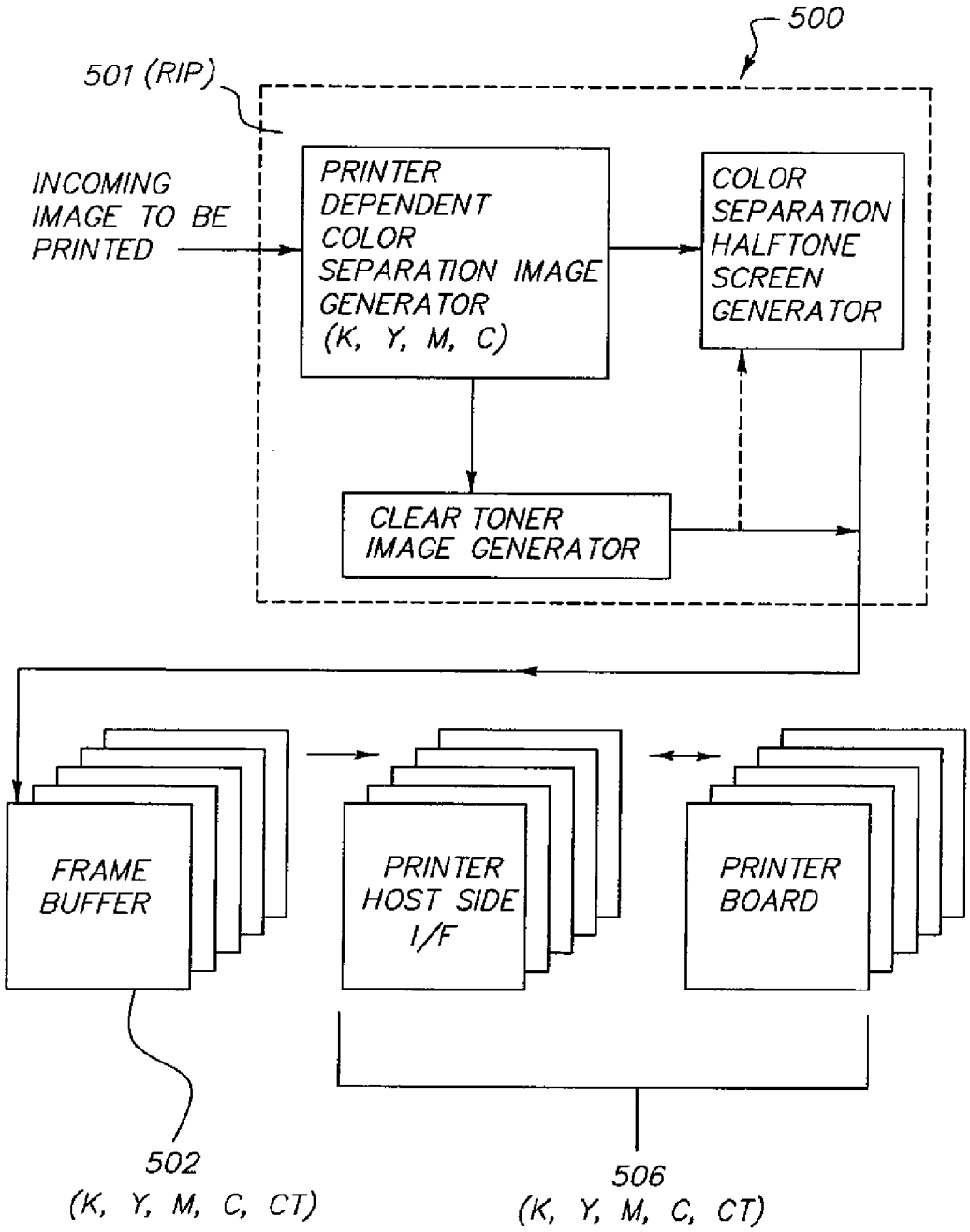
FIG. 7 is a schematic diagram of an image processing system for providing image data to color and clear toner printing assemblies of the apparatus of FIGS. 1A and B in accordance with the present invention.
Figure 8:
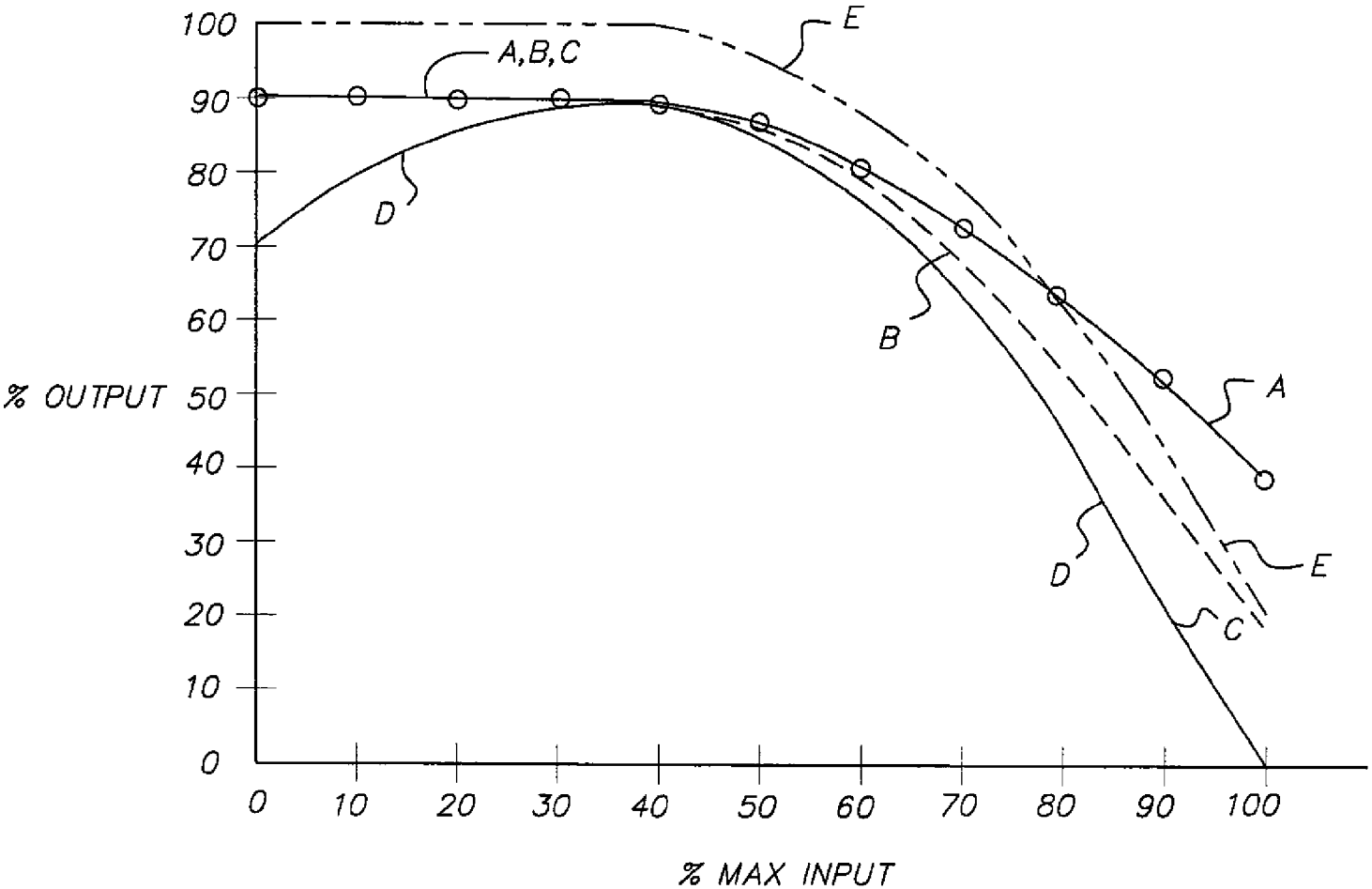
FIG. 8 is an exemplary graph illustrating amounts of clear toner to be deposited at pixel locations versus amounts of pigmented toner in a multicolor image using an inverse mask for depositing the clear toner as an overcoat.

With reference now to FIG. 7, image data for writing by the printer apparatus 500 may be processed by a RIP 501, which may include a color separation screen generator or generators. The output of the RIP 501 may be stored in frame or line buffers 502 for transmission of the color separation print data 506 to each of the respective LED writers K, Y, M, and C (which stand for black, yellow, magenta, and cyan respectively). The RIP 501 and/or color separation screen generator may be a part of the printer apparatus or remote there from. Image data processed by the RIP 501 may be obtained from a color document scanner or a digital camera, or generated by a computer or from a memory or network which typically includes image data representing a continuous image that needs to be reprocessed into halftone image data in order to be adequately represented by the printer. The RIP 501 may perform image processing processes including color correction, etc. in order to obtain the desired color print. Color image data is separated into the respective colors and converted by the RIP 501 to halftone dot image data in the respective color using threshold matrices, which include desired screen angles and screen rulings. The RIP 501 may be a suitably programmed computer and/or logic devices, and is adapted to employ stored or generated threshold matrices and templates for processing separated color image data into rendered image data in the form of halftone information suitable for printing.

With continued reference to FIG. 7, incoming image data to be printed is input to the RIP 501 and converted to printer dependent color separation image data in each of the four-color images to be printed by the printer apparatus 100. The clear toner image generator, which also may be a part of the RIP 501, creates a clear toner "image" from the four color separation images previously created, as will be further described in more detail below, assuming that glossing is to be done and an inverse mask is to be established for printing of the clear toner. A halftone screen generator or generators may also form a part of the RIP 501 and convert each of the four-color separation images into color separation halftone screened images. Additionally, the halftone screen generators may also convert the clear toner "image" into a halftone screen pattern (see dashed line) of image information, or alternatively (see full line) the clear toner, whether printed as an inverse mask or uniform overcoat, may be established using continuous tone and not halftone printing. The image data from each of the four halftone screened color separation images and clear toner halftone screen separation image are output to frame buffers 502 K, Y, M, C, and clear toner respectively, from which they are sent to a printer host side interface. A printer board communicates with the printer host side interface and includes supporting circuitry for outputting corrected image information for printing by each of the respective writers 506 K, Y, M, C, and clear toner with appropriate synchronization. The clear toner image for the inverse mask overcoat is determined as will be described below and printed using the fifth printer module M5.

With reference now also to FIG. 8, an example of a general relationship between density of a color image at a particular pixel location or image area and a preferred amount of clear toner to be applied to the area as an inverse mask is shown. As may be noted from the graph curve "A", a 90% coverage level of clear toner or clear toner is employed at pixel locations or image areas where color separation image percent is from 0% to 40%, i.e. the highlight region to the midtone region. For pixel locations or image areas where color separation image percent is greater than 40%, the midtone ranges through to the shadow region, where toner buildup is greatest, there is a generally gentle roll-off providing a progressive decrease in percent of clear toner laid down with increases of color density or color separation image coverage. The generation of the "image" map for depositing the clear toner is generated for each pixel location for the clear toner "image." The generated image map, for the clear toner image, may be subjected to processing through a halftone screen generator or instead be of a continuous tone. The halftone screen generated image information for each the five-color separation images and the image data for the clear toner image are modified to printer dependent image data and stored in frame buffers 502 (FIG. 7). The printer image data may also provide for correction for non-uniformities of the recording elements and/or other correction information or more preferably this can be provided on the printer board.

In accordance with well known techniques for printing, the information stored in the frame buffers 502 are output at suitably synchronized times for imaging of the respective electrostatic color separation images during the single pass by the respective writers as described above. As a convenience in calculation, rather than determining pigmented toner coverage at any pixel area in accordance with the sum of the four color contributions at that pixel location, one may select the maximum pixel percent contribution by a color separation at that pixel location as the percentage of pigmented toner coverage present at that location for use in determining the amount of clear toner overcoat to be applied in the inverse mask in accordance with the graph of FIG. 8. The use of the single color that is maximum at that location, in conjunction with the particular selected inverse mask curve's roll-off starting at the midtone, helps ensure that total toner coverage of the four colors plus clear toner at the pixel location is below 320% and this is basically true for the entire color gamut. As a further convenience in calculation, in lieu of making such calculation for the inverse mask using a pixel-by-pixel calculation, one may group local areas of say 4×4 pixels or 16 pixels to determine the amount of clear toner in the inverse mask calculation for this small area formed by a group of pixels.

The specific inverse masks illustrated in FIG. 8, are merely exemplary. The inverse mask illustrated by curve "A" and described above, may be referred to as a 90/90/40 mask illustrating the relationship from the highlight region to the midtone region and then with a gradual roll-off in the midtone region to the shadow region. The inverse mask illustrated by curve "B" may be referred to as a 90/90/20 inverse mask. The inverse mask illustrated by curve "C" may be referred to as a 90/90/00 inverse mask. The inverse mask illustrated by curve "D" may be referred to as a 70/90/00 inverse mask. This latter mask conserves on clear toner use in the highlight region.

The use of an inverse mask that employs less than 100% clear toner coverage at the highlight region to the midtone region, for example only 70% to 90% coverage, not only provides for conserving, and not overusing, clear toner, but also provides for reducing the negative impact on color gamut when clear toner overlies the colors. Thus, not only cost savings are realized, but an additional advantage of color gamut maintenance is obtained. In considering percentage coverage, 100% coverage by the clear toner implies a representative small area is totally covered with clear toner, while for example, 90% coverage implies that only 90% of the small area is covered. This can be done using halftoning algorithms.

Other inverse masks more suited to matte type receiver members or uncoated receiver members may have an inverse mask providing greater amounts of clear toner in the highlight area. For example, for such papers, a 100/100/20 inverse mask (curve "E") might be used, it being understood that this refers to percentages of actual lay down of clear toner instead of differences in exposure setting for the writer that is used to "write" the clear toner image or inverse mask. The higher level for the inverse mask for the matte or uncoated receiver members appears to provide for reduction of pinhole artifacts. The inverse mask curve may be optimized to reduce gamut loss and may be variable in accordance with a substrate used for the receiver member or process stability (e.g. or Q/M). The roll-off at midtone ensures that there will be less loss of color gamut in the midtone (the place where color gamut is most affected by overlying clear toner), but yet providing sufficient protection at the highlight areas of the color image. The roll-off at midtone further ensures that the total toner coverage with the five toners (including clear) at any pixel location, is below 320% toner coverage level. In this regard, there is input or sensing of one or more of the factors including receiver member type, electrostatographic process conditions including sensing of, or determination of, toner charge to mass (Q/M), and toner type, and in response selecting a suitable inverse mask in accordance with the appropriate conditions.

In the case of using custom color profiles that use optimized conditions based on receiver member, inverse mask choices (continuous tone or halftone), and fusing conditions and glosser finishing conditions, one can get accurate color reproduction, as well as increase in gloss and color gamut at the same time in a variety of receiver members, as shown in FIG. 5. The procedure that one follows if the inverse mask path is chosen (selection "Yes" in step 322 and selection "Custom Color" in step 364 (see FIG. 6) is based on custom color profile built with an optimized inverse mask, fusing, and glossing conditions (if glossing is selected) for that receiver member. Color separation data is generated in step 362*b* based on the custom color profile build, then a clear toner inverse mask is generated in step 324*b* based on the color separation data of the image data and the optimized condition that the receiver member has chosen. The color data and the clear toner data is printed, developed, and fused in step 316. Then if glossing is selected, the receiver member is finished in the glosser in step 340.

In the case of using a custom color profiles that use optimized conditions based on receiver member, uniform clear toner overcoat choices, and fusing conditions and glosser finishing conditions, one can get accurate color reproduction, as well as increase in gloss and color gamut at the same time. The procedure that one follows if the uniform clear toner path is chosen (selection "No" in step 322 and selection "Custom Color" in step 366 (see FIG. 6) is based on custom color profile built with an optimized uniform clear coat, fusing, and glossing conditions (if glossing is selected) for that receiver member. Color separation data is generated in step 360*b* based on the custom color profile build, then a uniform clear toner overcoat is generated in step 328 based on the optimized conditions that follow from the chosen receiver member. The color data and the clear toner data is printed, developed, and fused in step 316. Then, if glossing is selected, the receiver member is finished in the glosser in step 340.

Figure 9:
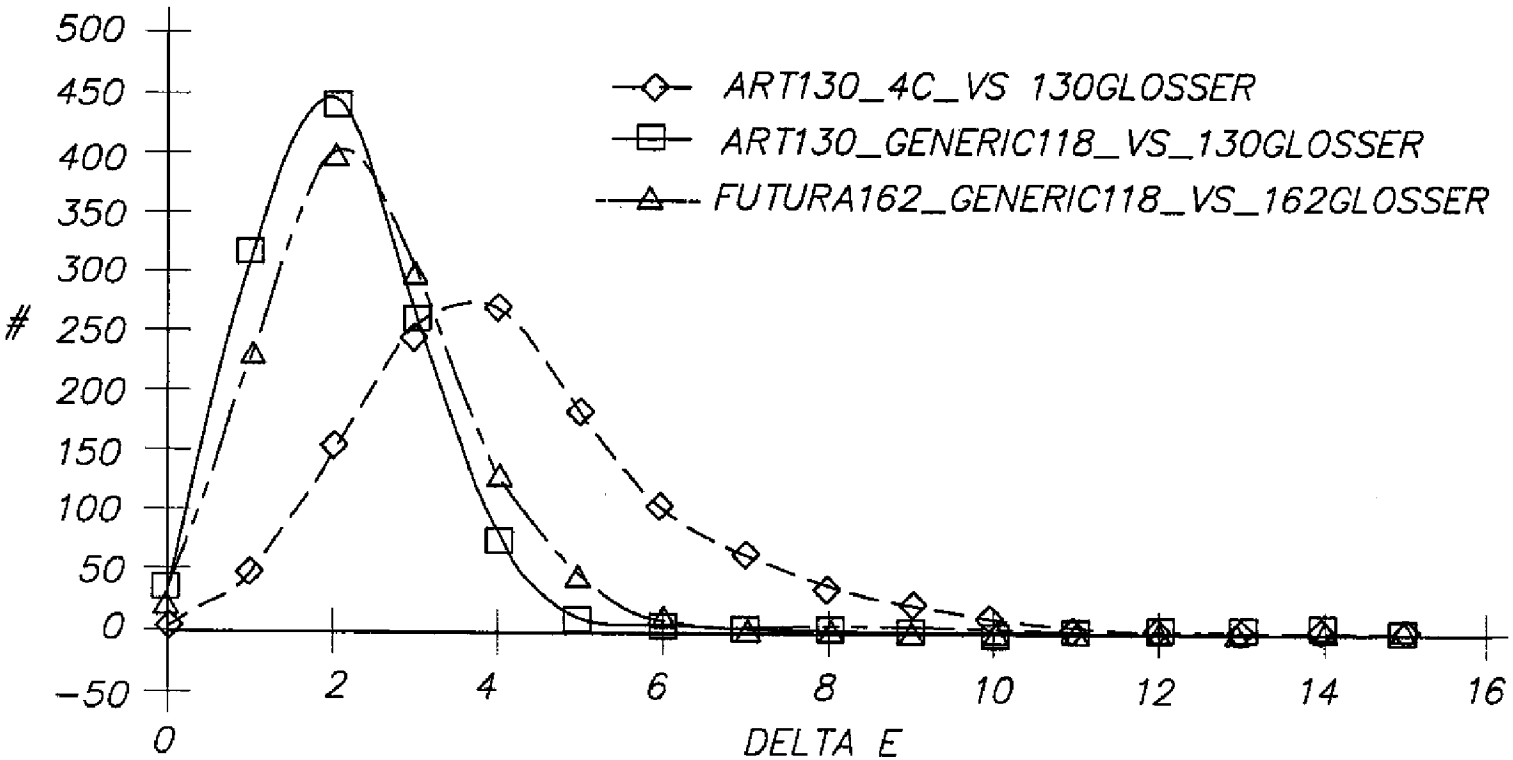
FIG. 9 shows a color error histogram comparison for a set of coated glossy paper receiver members using generic glosser color profile versus original (pre-glosser) profile with the belt fuser glosser.

The problem with custom color profiles, is that a lot of work is involved to build color profiles for a large variety of receiver members with optimized conditions (inverse mask, screens, etc.). If one does not build a custom color profile for the fuser/glossing process and just makes use of the original color profile for the four-color process (without the clear toner and glossing), since the color gamut has changed and also the glossing and fusing processes have different effects on different color separation layers (partially due to the presence of the clear toner inverse mask chosen, and partially due to the belt glossing process differences for different color layers), larger color errors exist, as shown in FIG. 9, when an Art130 coated glossy paper (paper weight is 130 gsm) using its' original four-color (4c) profile is used with the inverse mask and glosser process in comparison with a custom profile with an Art130 glosser color profile that was custom built. So it is desirable to reduce color errors and yet reduce the amount of work for building too many custom profiles (which is still an option). One way to do this, according to this invention, is via a generic color profile and generic inverse mask generation based on receiver member characteristics. In FIG. 9, a better color accuracy (than using a 4c profile) is shown using a generic 118 color profile (from a coated glossy 118 gsm paper) on the Art130 coated glossy paper and a Futura162 (162 gsm) coated glossy paper. In both cases, a 90/90/00 generic inverse mask (curve C of FIG. 8) is used.

Figure 10:
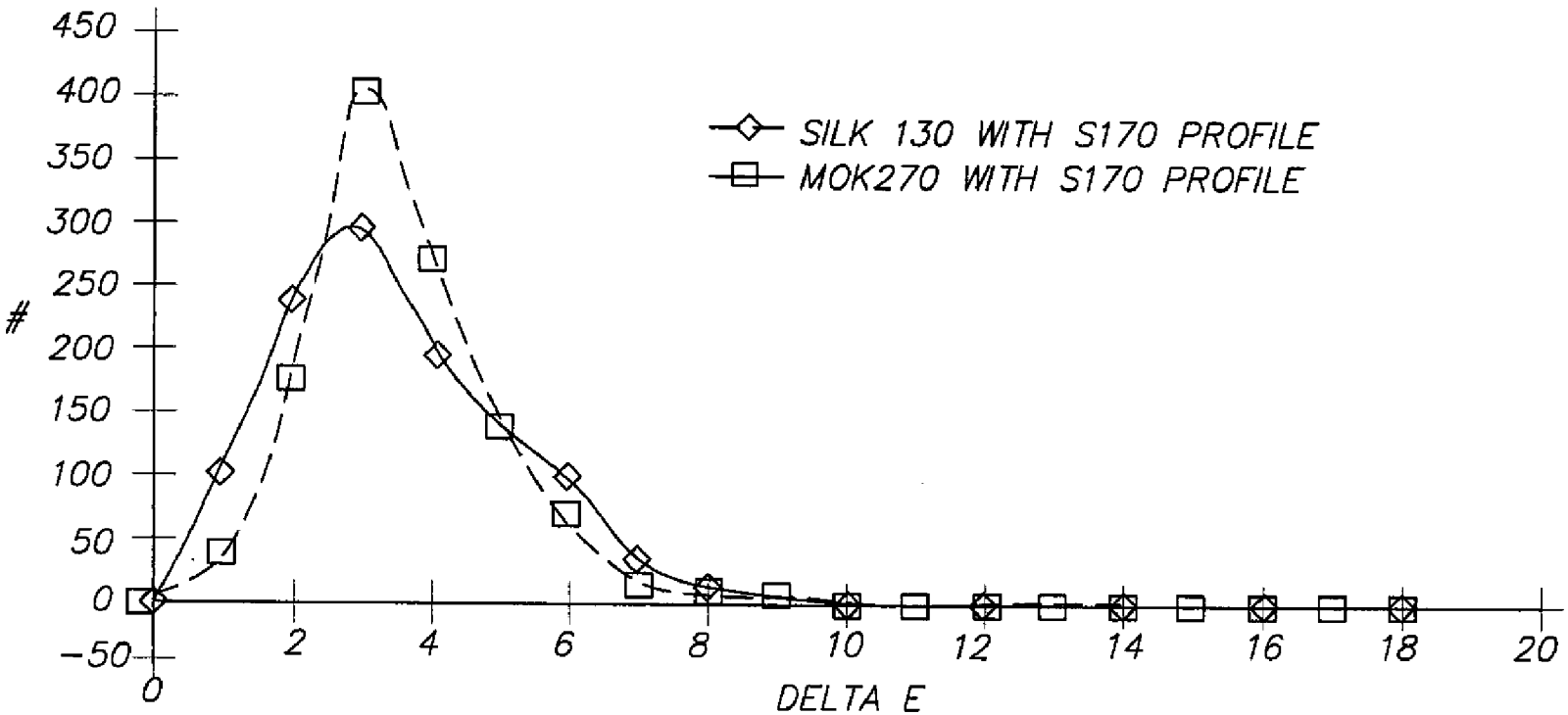
FIG. 10 shows a color error histogram for a set of coated matte paper receiver members using generic glosser color profile.

In FIG. 10, the color accuracy of two coated matte papers (Silk130 (130 gsm) and Mok270 (270 gsm)) is shown using a generic color profile from a Silk170 (170 gsm) coated matte paper with a 100/100/20 generic inverse mask (curve E of FIG. 8).

For coated glossy paper (typically with a Shefield smoothness number less than 30), a 90/90/00 generic inverse mask is sufficient to fill the holes on such paper to make the surface smooth without pinholes after the fusing and the belt-glossing step. For coated matte paper (typically a Shefield smoothness number greater than 30), a 100/100/20 generic inverse mask is more suitable to fill the holes on such paper in the fusing and belt-glossing step. For most uncoated paper, a generic 100/100/20 inverse mask can be used. Due to the higher roughness of some uncoated paper (with a Shefield number greater than 100), larger particle clear toner or higher lay down (such as can be induced via higher exposure) may be needed to overcome the pinhole and other artifact issues. Accordingly, the paper characteristics such as surface smoothness can typically be used as a guideline to select a generic inverse mask for use in this fusing/glossing process. Alternatively, one can use the paper type (such as coated glossy, coated matte, and uncoated since there is a general relationship between the paper smoothness and paper type) as guidelines for the selection of a generic clear toner inverse mask for use. The fusing conditions are still affected not just by the paper type, but also the paper weight and surface gloss conditions. When new paper of limited information is introduced (for example typically the paper type and paper weight is known, but not the paper smoothness), one can use the generic color profile selection to get the closest suitable inverse mask for the paper type and fusing/glossing condition for similar paper (such as type, weight, gloss, etc.).

Figure 11:
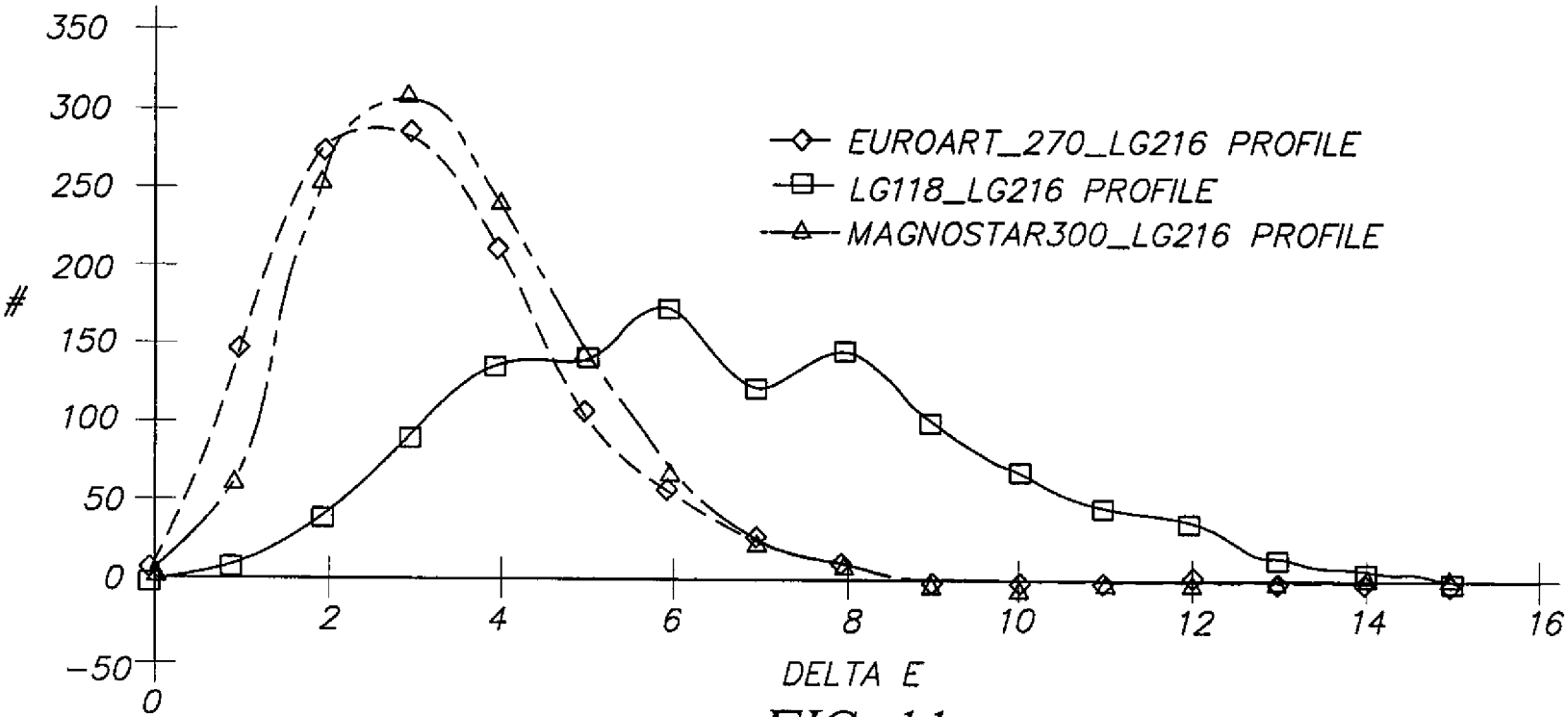
FIG. 11 shows a color error histogram for another set of coated glossy paper receiver members using generic glosser color profile.

In the case of generic color profile, it is a little more complicated than just selecting the closest generic profile for the paper type (such as coated glossy or coated matte). Due to the different effects of the glosser on different color layers, which also interact with the receiver member/paper, the glossy paper sometimes does not behave like the matte paper. In the case of the coated matte paper, a generic color profile of the Silk170 (170 gsm paper with a Shefield smoothness number of 39) profile using the glosser (FIG. 10) appears to work quite well when it is applied on a wide range of paper weights ((e.g., a range from 130 gsm Silk130 (with a Shefield smoothness number of 28) to 270 gsm Mok270 (with a Shefield smoothness number of 51)) in FIG. 10. However, for some of the smooth coated glossy paper, that is not necessarily the case. In FIG. 11, the color error of applying the generic color profile of a coated glossy paper LG216 (with a Shefield smoothness number of 16) after the glosser on a 270 gsm Euroart 270 paper (with a Shefield smoothness number of 12), a 300 gsm Magnostar300 (with a Shefield smoothness number of 15) and a 118 gsm LG118 (with a Shefield smoothness number of 10) is shown. It appears that for the higher weight papers, the result is quite good, but not for the lower weight paper such as the LG118. On the other hand, when the coated glossy LG118 generic glosser profile is applied on a 130 gsm Art130 coated glossy paper (with a Shefield smoothness number of 11) and on a 162 gsm Futura162 coated glossy paper (with a Shefield smoothness number of 29) as shown in FIG. 9, the result is quite good. So it appears that for the coated glossy paper category, a generic color profile (such as LG118) can be used for a weight range below 200 gsm, and another generic color profile (such as LG216) can be used for a higher weight range equal to or above 200 gsm with some satisfaction. Other influences on the generic color profile decision can also be based on the paper color; for example, if the deltaE from neutral is beyond a limit, for example 5 deltaE unit, a different generic color profile may need to be chosen since the overall hue of the system is different. It appears that a limited set of paper characteristics (such as paper color, paper type, paper weight, etc.) can be used to reduced the number of generic clear toner inverse mask and generic color profiles to be carried in the system for the glosser when new papers are introduced for printing in the system with some satisfactory result, without necessarily having to build a custom color profile (which can be more accurate and costly, but still an option).

Figure 12:
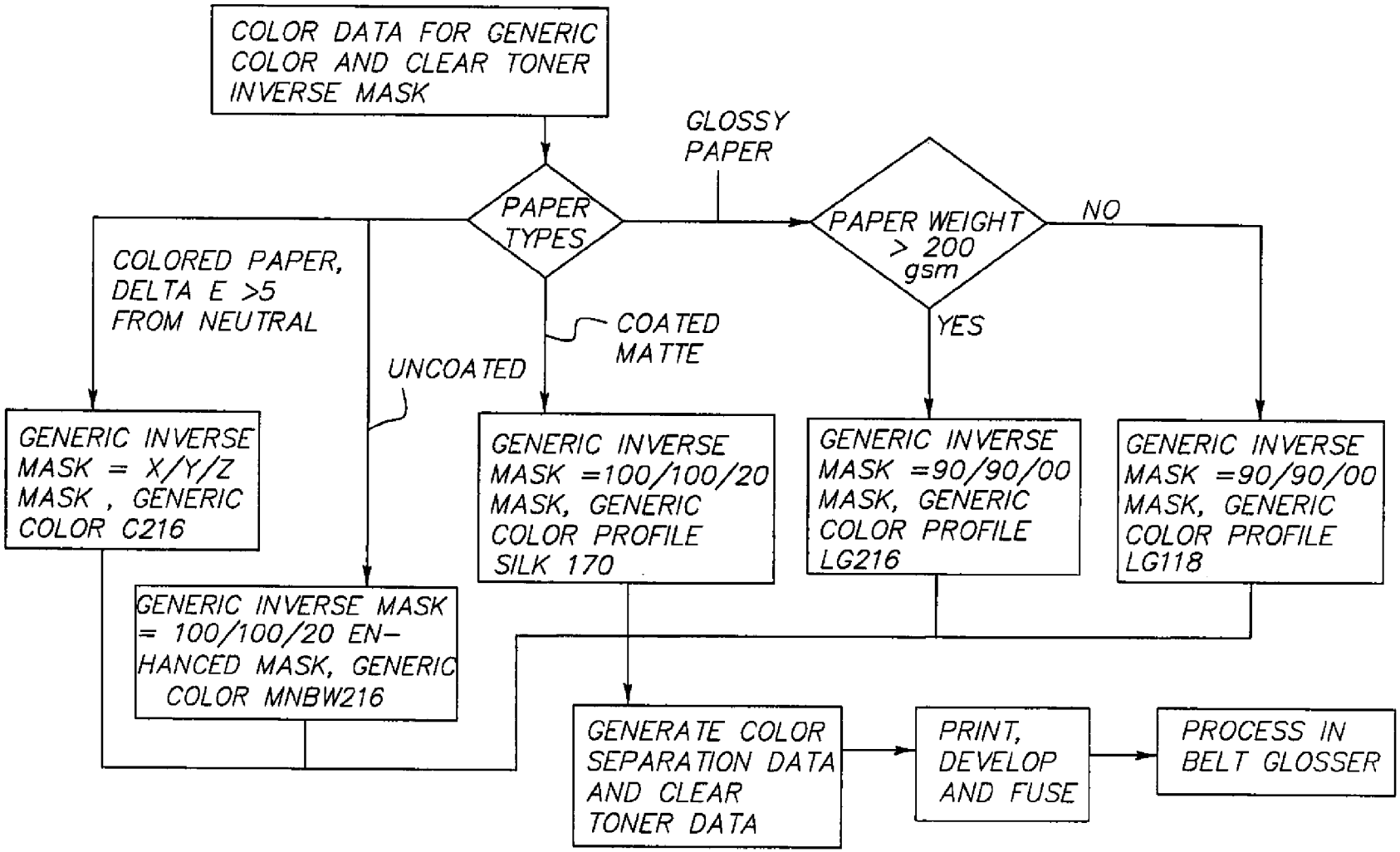
FIG. 12 shows a block diagram of a generic clear toner inverse mask and generic color profile selection process based on receiver member characteristics.

FIG. 12 shows a block diagram of a generic clear toner inverse mask and generic color profile selection process based on receiver member characteristics, such as for example, paper weight or color (significantly different from neutral). Then, when the generic approach is not sufficient for color accuracy purpose, custom color profile (as shown in FIG. 6) can be used to improve the accuracy.

Figure 13:
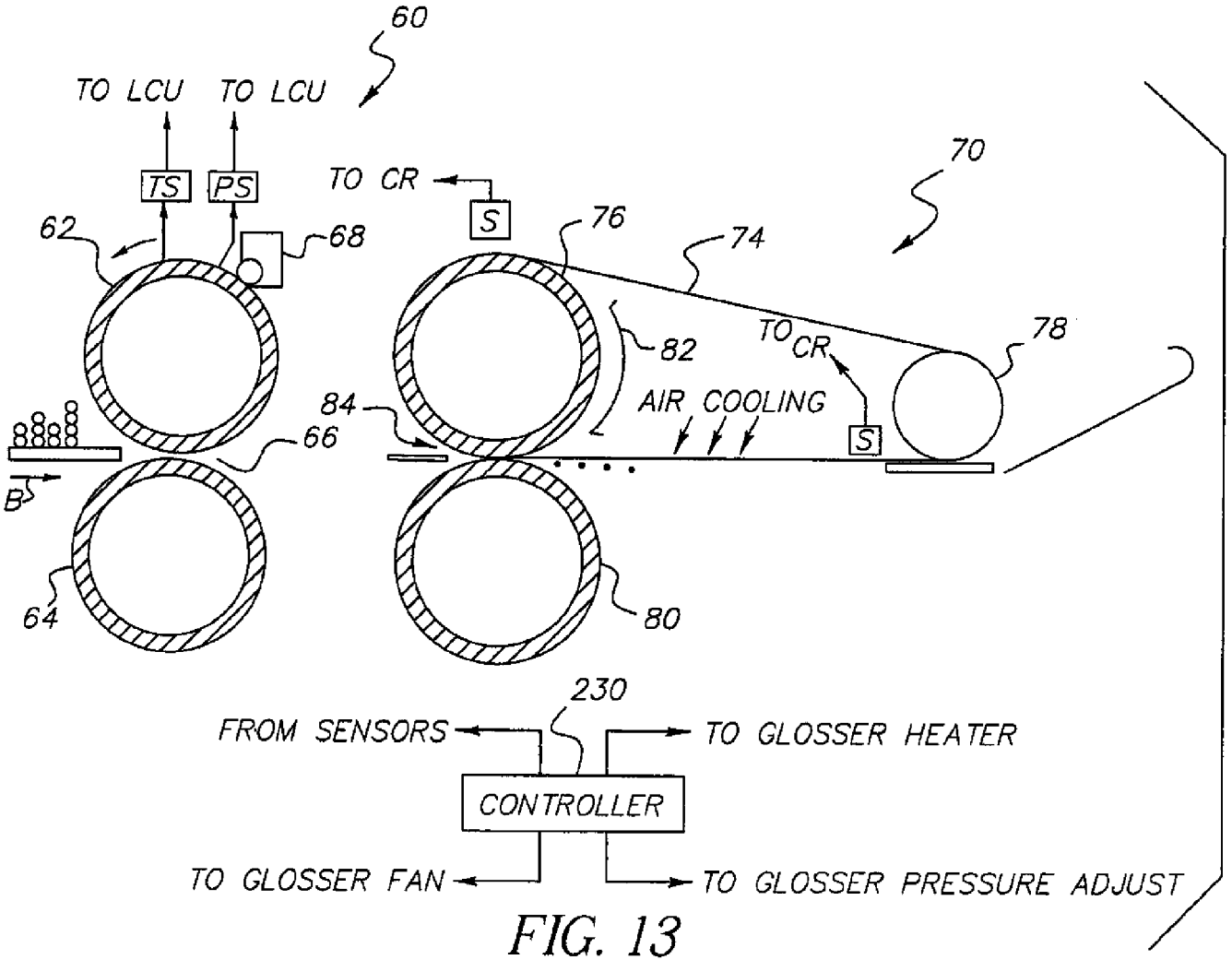
FIG. 13 shows a schematic illustration of a belt glosser apparatus in conjunction with a printing assembly.

FIG. 13 shows a schematic illustration of a belt glosser apparatus in conjunction with a printing assembly.

The invention has been described in detail with particular reference to certain preferred embodiments thereof, but it will be understood that variations and modifications can be effected within the spirit and scope of the invention.

PARTS LIST

| | |
|---|---|
| 60 | Fusing assembly |
| 62 | Fusing roller |
| 64 | Pressure roller |
| 66 | Fusing nip |
| 68 | Release fluid application subassembly |
| 69 | Remote output tray |
| 70 | Glossing assembly |
| 74 | Fusing belt |
| 76 | Glossing roller |
| 78 | Steering roller |

-continued

PARTS LIST

| | |
|---|---|
| 80 | Pressure roller |
| 82 | Heat Shield |
| 84 | Glossing nip |
| 101 | Transport web |
| 102, 103 | Roller |
| 105 | Power supply unit |
| 111 (PC1), 121 (PC2), 131, (PC3), 141 (PC4), 151 (PC5) | Photoconductive imaging rollers |
| 112 (ITM1), 122 (ITM2), 132 (ITM3), 142 (ITM4), 152 (ITM5) | Intermediate transfer members |
| 113 (TR1), 123 (TR2), 133 (TR3), 143 (TR4), 153 (TR5) | Transfer backup rollers |
| 124, 125 | Corona tack-down chargers |
| 200 | Module |
| 201 | Transfer nip |
| 202 | Transfer nip |
| 205 | Photoconductive imaging member |
| 206 | Surface |
| 210 | Primary charging subsystem |
| 211, 212 | Meters |
| 215 | Intermediate transfer member |
| 216 | Surface |
| 220 | Exposure subsystem |
| 225 | Development subsystem |
| 230 | Logic and Control Unit (LCU) |
| 235 | Backup roller |
| 236, 237 | Receiver members |
| 238 | Color separation image |
| 240 | Power source |
| 245 | Controller |
| 300 | Flowchart |
| 310 | Step - Multicolor processing image data |
| 316 | Step - Printer color separations, clear toner overcoat, and fuse image |
| 322 | Step - Inverse mask selected |
| 324a | Step - Generate clear toner inverse mask image based on substrate characteristics |
| 324b | Step - Generate clear toner inverse mask image based on substrate characteristics and custom profile settings |
| 328 | Step - Generate uniform clear toner overcoat image using fifth toning assembly with overcoat adjusted for substrate type |
| 340 | Step - Process in belt glosser |
| 360a | Step - Generate color separations with generic color profile based on uniform clear toner and substrate characteristics |
| 360b | Step - Generate color separations with custom color profile based on uniform clear toner and substrate characteristics |
| 362a | Step - Generate color separations with generic color profile based on substrate characteristics |
| 362b | Step - Generate color separations with custom color prints |
| 364 | Step - Generic or custom color profile |
| 366 | Step - Generic or custom color profile |
| 500 | Printer apparatus |
| 501 | Raster Image Processor (RIP) |
| 502 | Frame buffers |
| 506 | Color separation print data |
| B | Arrow representing the direction of the receiver member |
| M1 | Module - black (K) |
| M2 | Module - yellow (Y) |

-continued

| PARTS LIST | |
|---|---|
| M3 | Module - magenta (M) |
| M4 | Module - cyan (C) |
| M5 | Module - clear/specialty |
| $R_n$, $R_{(n-1)}$, $R_{(n-2)}$, $R_{(n-3)}$, $R_{(n-4)}$, $R_{(n-5)}$, $R_{(n-6)}$ | Receiver members |
| S | Arrow representing the direction of the receiver member |

What is claimed is:

1. A method of forming a multicolor image on a receiver member comprising:

forming a multicolor toner image on the receiver member with toners of at least three different colors of toner pigments which form various combinations of colors at different pixel locations on the receiver member to form the multicolor toner image thereon using a generic color profile based on receiver member characteristics;

forming a clear toner overcoat upon the multicolor toner image;

pre-fusing the multicolor toner image and clear toner overcoat to the receiver member to at least tack the toners forming the multicolor toner image and the clear toner overcoat; and fusing the clear toner overcoat and the multicolor toner image using a belt fuser to fix the clear toner overcoat to the receiver member and/or provide an improved gloss to the multicolor toner image.

2. A method of forming a multicolor image on a receiver member according to claim 1 wherein the generic color profile is based on receiver member type.

3. A method of forming a multicolor image on a receiver member according to claim 2 wherein when the receiver member type is glossy, there is one generic color profile for a paper weight range below 200 gsm, and another generic color profile for paper weight of at least 200 gsm.

4. A method of forming a multicolor image on a receiver member according to claim 1 wherein the generic color profile is based on receiver member surface smoothness.

5. A method of forming a multicolor image on a receiver member according to claim 4 wherein for matte paper the generic color profile is based on a smoothness with a Shefield smoothness number of approximately 39, and for coated glossy paper the generic profile is based on a smoothness of with a Shefield smoothness number of approximately 16.

6. A method of forming a multicolor image on a receiver member according to claim 5 wherein the generic color profile with a Shefield smoothness number of approximately 39 applies to matte paper from approximately 130 gsm to 270 gsm, and the generic color profile with a Shefield smoothness number of approximately 16 applies to glossy coated paper from approximately 200 gsm to 300 gsm.

7. A method of forming a multicolor image on a receiver member according to claim 1 wherein the generic color profile is based on receiver member color.

8. A method of forming a multicolor image on a receiver member comprising:

forming a multicolor toner image on the receiver member with toners of at least three different colors of toner pigments which form various combinations of color at different pixel locations on the receiver member to form the multicolor toner image thereon using a generic color profile based on receiver member characteristics;

forming a clear toner overcoat upon the multicolor toner image, the clear toner overcoat being deposited as an inverse mask;

pre-fusing the multicolor toner image and clear toner overcoat to the receiver member to at least tack the toners forming the multicolor toner image and the clear toner overcoat; and fusing the clear toner overcoat and the multicolor toner image using a belt fuser to fix the clear toner overcoat to the receiver member and/or provide an improved gloss to the multicolor toner image.

9. A method of forming a multicolor image on a receiver member according to claim 8 wherein the generic color profile is based on receiver member type.

10. A method of forming a multicolor image on a receiver member according to claim 8 wherein the generic color profile is based on receiver member surface smoothness.

11. A method of forming a multicolor image on a receiver member according to claim 8 wherein the generic color profile is based on receiver member color.

12. A method of forming a multicolor image on a receiver member comprising:

forming a multicolor toner image on the receiver member with toners of at least three different colors of toner pigments which form various combinations of color at different pixel locations on the receiver member to form the multicolor toner image thereon using a generic color profile based on receiver member characteristics;

forming a clear toner overcoat upon the multicolor toner image, the clear toner overcoat being deposited as a generic inverse mask based on receiver member characteristics;

pre-frising the multicolor toner image and clear toner overcoat to the receiver member to at least tack the toners forming the multicolor toner image and the clear toner overcoat; and fusing the clear toner overcoat and the multicolor toner image using a belt fuser to fix the clear toner overcoat to the receiver member and/or provide an improved gloss to the multicolor toner image.

13. A method of forming a multicolor image on a receiver member according to claim 12 wherein the generic color profile is based on receiver member type.

14. A method of forming a multicolor image on a receiver member according to claim 12 wherein the generic color profile is based on receiver member surface smoothness.

15. A method of forming a multicolor image on a receiver member comprising:

forming a multicolor toner image on the receiver member with toners of at least three different colors of toner pigments which form various combinations of color at different pixel locations on the receiver member to form the multicolor toner image thereon;

forming a clear toner overcoat upon the multicolor toner image, the clear toner overcoat being deposited as a generic inverse mask based on receiver member characteristics;

pre-fusing the multicolor toner image and clear toner overcoat to the receiver member to at least tack the toners forming the multicolor toner image and the clear toner overcoat; and fusing the clear toner overcoat and the multicolor toner image using a belt fuser to fix the clear toner overcoat to the receiver member and/or provide an improved gloss to the multicolor toner image.

16. A method of forming a multicolor image on a receiver member according to claim 15 wherein the generic color profile is based on receiver member type.

17. A method of forming a multicolor image on a receiver member according to claim 15 wherein the generic color profile is based on receiver member surface smoothness.

* * * * *

UNITED STATES PATENT AND TRADEMARK OFFICE

CERTIFICATE OF CORRECTION

PATENT NO. : 7,340,208 B2
APPLICATION NO. : 11/155268
DATED : March 4, 2008
INVENTOR(S) : Yee S. Ng It is certified that error appears in the above-identified patent and that said Letters Patent is hereby corrected as shown below:

Column 18, Line 36, delete “pre-frising” and insert --pre-fusing--

Signed and Sealed this

Twenty-sixth Day of May, 2009

JOHN DOLL
*Acting Director of the United States Patent and Trademark Office*